US010779622B2

(12) United States Patent
Suarez et al.

(10) Patent No.: US 10,779,622 B2
(45) Date of Patent: Sep. 22, 2020

(54) LUGGAGE ARTICLE FRAME STRUCTURE

(71) Applicant: Samsonite IP Holdings S.a r.l., Luxembourg (LU)

(72) Inventors: Leticia Suarez, Mansfield, MA (US); George Teixeira, Warren, RI (US); Janel Twogood, Providence, RI (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 281 days.

(21) Appl. No.: 15/835,390

(22) Filed: Dec. 7, 2017

(65) Prior Publication Data

US 2019/0166967 A1 Jun. 6, 2019

Related U.S. Application Data

(63) Continuation-in-part of application No. 29/628,096, filed on Dec. 1, 2017, and application No. 15/835,390, said application No. 29/628,103.

(51) Int. Cl.
*A45C 13/04* (2006.01)
*A45C 5/03* (2006.01)
(Continued)

(52) U.S. Cl.
CPC ..... *A45C 13/04* (2013.01); *A45C 5/02* (2013.01); *A45C 5/03* (2013.01); *A45C 5/14* (2013.01);
(Continued)

(58) Field of Classification Search
CPC ..... A45C 13/04; A45C 13/06; A45C 13/36
(Continued)

(56) References Cited

U.S. PATENT DOCUMENTS 2,298,786 A 10/1942 Dubofsky et al.
4,055,239 A 10/1977 Weiner et al.
(Continued)

FOREIGN PATENT DOCUMENTS

CA 2760430 A1 6/2012
EM 0052852440002 5/2018
(Continued)

OTHER PUBLICATIONS

Samsonite, "Samsonite Flexis 21" Spinner, https://shop.samsonite.com/samsonite-flexis-21-spinner/1102391465.html?rrec=true, Oldest Review Dec. 2018, 2018, 5 pages.
(Continued)

*Primary Examiner* — Sue A Weaver
(74) *Attorney, Agent, or Firm* — Dorsey & Whitney LLP

(57) ABSTRACT

A luggage article 100 is provided. The luggage article 100 may include a reinforcing board 202, and a closed loop frame 206. The reinforcing board 206 may include a central portion 220 and first and second side portions 224, 226 on opposing lateral sides of the central portion 220. The central portion may extend over a rear side 120 of the luggage article 100. The first and second side portions 224, 226 may extend over at least part of the opposing left 126 and right 128 sides of the luggage case 100. The closed loop frame 206 may match and aligned with the distal edge 250 of the first side portion 224 or the second side portion 226 of the reinforcing board 220. The top section 226 of the closed loop frame may also curve around the top edges (142, 144) of the luggage case 100 to extend at least partially over the top side 122 to match and align with the inwardly curved side edge 282 of the top portion 228.

41 Claims, 13 Drawing Sheets

(51) Int. Cl.
*A45C 5/14* (2006.01)
*A45C 13/36* (2006.01)
*A45C 5/02* (2006.01)

(52) U.S. Cl.
CPC ..... *A45C 13/36* (2013.01); *A45C 2005/035* (2013.01); *A45C 2005/037* (2013.01)

(58) Field of Classification Search
USPC ..... 190/24, 127, 20, 122
See application file for complete search history.

(56) References Cited

U.S. PATENT DOCUMENTS

| | | | | |
|---|---|---|---|---|
| 4,895,230 | A | 1/1990 | King | |
| 5,833,039 | A | 11/1998 | Kotkins, Jr. | |
| 6,119,835 | A * | 9/2000 | Lin | A45C 5/14 190/115 |
| 6,148,973 | A * | 11/2000 | Chang | A45C 5/14 190/115 |
| D463,663 | S | 10/2002 | Magana | |
| 6,502,677 | B1 | 1/2003 | Tiramani et al. | |
| D479,042 | S | 9/2003 | Szyf | |
| D493,283 | S | 7/2004 | Rada et al. | |
| 6,883,654 | B2 | 4/2005 | Godshaw et al. | |
| 7,188,714 | B1 | 3/2007 | Herold et al. | |
| 7,278,539 | B2 | 10/2007 | Souza | |
| D601,342 | S | 10/2009 | Choi | |
| D603,163 | S | 11/2009 | Van | |
| D630,850 | S | 1/2011 | Gifford | |
| D644,838 | S | 9/2011 | Tong | |
| D665,997 | S | 8/2012 | Meersschaert | |
| 8,695,770 | B2 | 4/2014 | Santy | |
| D731,181 | S | 6/2015 | Majeau et al. | |
| D751,820 | S | 3/2016 | Recchia | |
| D755,523 | S | 5/2016 | Szyf et al. | |
| 9,375,062 | B2 | 6/2016 | Collins et al. | |
| D774,758 | S | 12/2016 | Hopwood et al. | |
| D809,294 | S | 2/2018 | Tong | |
| D810,434 | S | 2/2018 | Xu | |
| 10,292,472 | B2 | 5/2019 | Santy et al. | |
| 2003/0038010 | A1 * | 2/2003 | Kuwayama | A45C 5/02 190/127 |
| 2004/0007434 | A1 | 1/2004 | Godshaw et al. | |
| 2005/0077135 | A1 | 4/2005 | Drew et al. | |
| 2008/0196988 | A1 | 8/2008 | Tong | |
| 2008/0223678 | A1 | 9/2008 | Godshaw et al. | |
| 2011/0162931 | A1 | 7/2011 | Collins et al. | |
| 2012/0090934 | A1 | 4/2012 | Keir | |
| 2016/0029763 | A1 * | 2/2016 | Meersschaert | A45C 5/02 190/18 A |

FOREIGN PATENT DOCUMENTS

| | | | |
|---|---|---|---|
| EM | 0052852440003 | | 5/2018 |
| EP | 1251760 | B1 | 3/2008 |
| EP | 2512279 | A1 | 10/2012 |
| EP | 2592963 | A1 | 5/2013 |
| EP | 2537432 | A3 | 5/2014 |
| EP | 2729033 | A1 | 5/2014 |
| EP | 2787857 | B1 | 4/2016 |
| EP | 2139357 | B1 | 5/2016 |
| EP | 2982263 | B1 | 7/2017 |
| EP | 3494829 | A1 | 6/2019 |
| WO | 2011/033218 | A1 | 3/2011 |

OTHER PUBLICATIONS

American Tourister, "Matchup Valise 4 roues 79cm", https://www.americantourister.fr/matchup-valise-4-roues-79cm-popcorn-yellow/124712-1709.html?cgid=luggage_soft-suitcases, Accessed Jun. 14, 2019, 4 pages.

Samsonite, "Samsonite Eco-Nu 20" Expandable Spinner, https://shop.samsonite.com/luggage/carry-on-luggage/samsonite-eco-nu-20-expandable-spinner-/107639XXXX.html?dwvar_107639XXXX_color=Raspberry&cgidmaster=lugaz, 2018, 6 pages.

* cited by examiner

LUGGAGE ARTICLE FRAME STRUCTURE

CROSS REFERENCE TO RELATED APPLICATIONS

This application is a continuation-in-part and claims priority under 35 U.S.C. § 120 to U.S. application Ser. No. 29/628,096 filed Dec. 1, 2017, and this application is also a continuation-in-part and claims priority under 35 U.S.C. § 120 to U.S. application Ser. No. 29/628,103 filed Dec. 1, 2017, both of which are hereby incorporated by reference in their entireties.

TECHNICAL FIELD

The present disclosure relates generally to luggage articles, and more specifically to a luggage article frame structure.

BACKGROUND

Some luggage cases include a frame structure or arrangement to support a softside or hybrid luggage case housing. Many frame structures include rectangular wire loop frames for the lateral sides of luggage cases. Traditional frame configurations, however, often include relatively sharp corners or edges along the intersection between adjacent housing panels. These corners or edges may include piping or beading along a seam to help prevent wear and damage. Notwithstanding, such configurations are frequently prone to high levels of wear, and even failure, along the seams and edges through abrasion, seam, and/or corner damage. For example, a sharp edge at the intersection between adjacent housing panels may create an inherently weak point of construction that is prone to damage.

Additionally, luggage cases generally protect the belongings within the luggage case, and often the rear or back side of the luggage case is strengthened with additional structure, such as additional reinforcing boards, which detrimentally increase the weight of the luggage case.

It is therefore desirable to provide an improved luggage case, and more specifically an improved frame structure that addresses one or all of the above described problems and/or which more generally offers improvements or an alternative to existing arrangements.

Documents that may be related to the present disclosure include CA2760430, EP1251760, EP2139357, EP2512279, EP2537432, EP2592963, EP2729033, EP2787857, EP2982263, U.S. Pat. Nos. 2,298,786, 4,055,239, 4,895,230, 5,833,039, 6,502,677, 6,883,654, 7,188,714, 7,278,539, 8,695,770, 9,375,062, US20110162931, and WO2011033218

SUMMARY

The present disclosure provides a luggage article, as described below and defined in the accompanying claims. The luggage article may be a softside luggage article including a frame structure. The frame structure may include a reinforcing board along a rear side of the luggage case. The reinforcing board may include one or more side portions extending from a central portion. The side portions may extend from the central portion over or along at least part of adjacent sides of the luggage case. The frame structure may include a closed loop frame supporting a side panel of the luggage case, the closed loop frame shaped to match and align with the side portions of the reinforcing board. The closed loop frame may be nonrectangular. For example, the closed loop frame may include an inwardly curved frame portion to match and align with curved distal edges of the side portions of the reinforcing board. The inwardly directed curved portion may be scallop-shaped.

Embodiments of the present disclosure may include a luggage article. The luggage article may include a housing, a reinforcing board, and a closed loop frame, which may support the housing. The housing may include opposing front and rear panels, opposing left and right side panels, and opposing top and bottom panels together defining front, rear, left, right, top, and bottom sides of the luggage article. The reinforcing board may include a central portion and first and second side portions on opposing lateral sides of the central portion. The central portion may extend over the rear side of the housing. The first and second side portions may extend over at least part of the opposing left and right sides of the housing. Each of the first and second side portions may include a distal edge. The closed loop frame may support one of the opposing left and right side panels. The closed loop frame may include a frame portion matching and aligned with the distal edge of the first side portion or the second side portion of the reinforcing board. In some examples, one of the first and second side portions supports one of the opposing left and right side panels. In another example, at least a portion of the side portion extends at least as far as a center line of the side panel. In another example, the closed loop frame includes a wire loop. In some examples the closed loop frame may include a top portion, wherein the top portion extends at least partially over the top side of the luggage article. The closed loop frame may be a wire loop in this example.

In some examples, the closed loop frame may include a front section, top and bottom sections extending from opposing ends of the front section, and a rear section extending from the top and bottom sections. The rear section may include a shape matching and aligned with the distal edge of the first side portion or the second side portion of the reinforcing board. The rear section may include a central section curved inwardly toward the front section to match and align with the distal edge of the first side portion or the second side portion of the reinforcing board. The front, top, and bottom sections of the closed loop frame may be substantially linear. The top and bottom sections may extend substantially perpendicularly from the front section. The rear section may connect the ends of the top and bottom sections together. In some examples, the side portion of the reinforcing board may be curved toward the front side of the luggage article to match and align with the rear section of the closed loop frame. In some examples, the distal edge of either or both of the side sections may have an arcuate shape. In some examples, the arcuate shape defines an apex, and the apex is positioned in a middle portion of the length of the front or rear sections.

In some examples, the closed loop frame may be coupled to the distal edge of the first side portion or the second side portion of the reinforcing board. In some examples, the rear section is curved toward the front section. In some examples, the rear section is a long side of the closed loop frame, and the curve has an arcuate shape. In some examples the curve defines an apex, which is positioned in a middle portion of the length of the left or right side.

In some examples, the luggage article may include a fabric seam aligned with the distal edges of the first and second side portions of the reinforcing board.

In some examples, the first and second side portions may be resiliently bent from the central portion to extend over at least part of the opposing left and right sides of the luggage article.

In some examples, the luggage article may include a first closed loop frame supporting the left side panel of the housing. The first closed loop may include a frame portion matching and aligned with the distal edge of the first side portion. The luggage article may include a second closed loop frame supporting the right side panel of the housing. The second closed loop frame may include a frame portion matching and aligned with the distal edge of the second side portion.

In some examples, the reinforcing board may include a top portion extending over at least part of the top side of the luggage article. The top portion may extend over a top front edge of the front side to form a top lip over a part of the top of the front panel. In some examples, the closed loop frame is a wire loop and includes an upper portion, and the upper portion may extend at least partially over the top side. Additionally, the top portion of the reinforcing board may define a curved side, and the upper portion of the closed loop frame mates with the curved side of the top portion of the reinforcing board.

The reinforcing board may include a bottom portion extending over at least part of the bottom side of the luggage article. The bottom portion may extend over a bottom front edge of the front side to form a bottom lip over a part of the bottom of the front panel. In some examples, a brace is coupled between the top portion of the reinforcing panel and a bottom portion of the reinforcing panel along left and right sides, and extends along a central portion between the front and back sides. The brace may be formed of two separate braces.

In some examples, the luggage article may include an outer fabric cover over at least part of the front, left, and right sides of the luggage article.

Some examples of the luggage article may include at least one wheel positioned on a bottom side of the luggage case. Other examples may include four wheels positioned on a bottom side of the luggage case. In another example of the luggage article, a door opening may be formed on the front side to selectively access the interior of the luggage case.

Embodiments of the present disclosure may include a luggage article. The luggage article may include a housing defining a rear edge between two adjacent sides, a reinforcing board including a first portion extending around the rear edge of the housing, and a closed loop frame including a frame portion matching and aligned with the first portion of the reinforcing board. In one further example, the first portion may define at least one curve, and the frame portion may define a mating curve to match and align with the curve defined by the first portion.

In some examples, the housing may include a rear panel, a left side panel, and a right side panel together defining rear, left, and right sides of the housing. The intersection between the rear side and the left side defining a left rear edge. The intersection between the rear side and right side defining a right rear edge. The first portion of the reinforcing board may curve around the left rear edge of the housing to extend at least partially over the left side of the housing. The reinforcing board may include a second portion extending around the right rear edge of the housing to extend at least partially over the right side of the housing. The closed loop frame may be a first closed loop frame supporting the left side panel of the housing. The luggage article may include a second closed loop frame supporting the right side panel of the housing. The second closed loop frame may include a frame portion matching and aligned with the second portion of the reinforcing board. The first and second portions of the reinforcing board may extend over only a rear portion of the left and right sides of the housing adjacent to the rear side. The closed loop frame may include a nonrectangular shape.

Embodiments of the present disclosure may include a method of manufacturing a luggage article. The method may include providing a reinforcing board, the reinforcing board including a central portion and one or more side portions extending from the central portion. The method may include positioning the central portion of the reinforcing board over a first side of the luggage article. The method may include wrapping the one or more side portions of the reinforcing board over a second side of the luggage article adjacent to the first side. The method may include positioning a closed loop frame adjacent to the one or more side portions of the reinforcing board, the closed loop frame including a frame portion matching and aligned with the one or more side portions of the reinforcing board.

In some examples, the one or more side portions of the reinforcing board may include first and second side portions on opposing lateral sides of the central portion. The closed loop frame may be positioned adjacent to the first side portion of the reinforcing board. The method may include positioning a second closed loop frame adjacent to the second side portion of the reinforcing board. The second closed loop frame may include a frame portion matching and aligned with the second side portion of the reinforcing board. In some examples, the method may include extending a top portion or a bottom portion of the reinforcing board over a top side or a bottom side of the luggage article.

Embodiments of the present disclosure may include a luggage article. The luggage article may include a housing defined by opposing front and rear panels, opposing left and right side panels, and opposing top and bottom panels together defining front, rear, left, right, top, and bottom sides of the luggage article. At least one of the panels may wrap around an edge of the housing to extend over a plurality of sides of the luggage article.

Embodiments of the present disclosure may include a luggage article having opposing front and rear panels, opposing left and right side panels, and opposing top and bottom panels together defining front, rear, left, right, top, and bottom sides of the luggage article. The back panel may include a rigid or semi-rigid reinforcing board defining side portions each extending around to cover at least a portion of the opposing left and right sides, respectively. The side portions may form a curve to extend around to cover the left and right sides.

In some examples, the side portions of the reinforcing board may extend along the sides at least as far as the centerline of the sides. Alternatively, the side portions of the reinforcing board may extend along the sides not further than the centerline of the sides.

In some embodiments, the luggage article may have opposing front and rear panels, opposing left and right side panels, and opposing top and bottom panels together defining front, rear, left, right, top, and bottom sides of the luggage article, where one of the left or right side panels (or both) may be non-rectangular, and either one or both may include a middle portion of a side having a curved shape. In one example, one of the left or right side panels has opposing long sides, with one of the long sides curved inwardly toward the other long side. In another example, one of the left or right side panels defines opposing short sides, with one of the short sides curved outwardly away from the other short side.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

According to the present disclosure, a frame structure is provided that is configured to support an outer fabric housing of a luggage article. The frame structure includes a reinforcing board along a back panel of the luggage article and one or more closed loop frame assemblies supporting a side panel of the luggage article. The reinforcing board may include shaped side portions that wrap around and extend over or along at least a portion of one or more sides of the luggage article. The closed loop frame may include a nonrectangular shape. For instance, the closed loop frame may include an inwardly extending portion to match and align with the shaped side portions of the reinforcing board. The shaped side portions of the reinforcing board may have a scalloped shape. The inwardly extending portion of the closed loop frame may have a scalloped shape to match a corresponding side portion of the reinforcing board. The reinforcing board may also include a top portion folded over or along the top of the luggage article, and/or a bottom portion folded over or along the bottom of the luggage article. The bottom portion of the reinforcing board may be attached to a bottom pan assembly.

Figure 1:
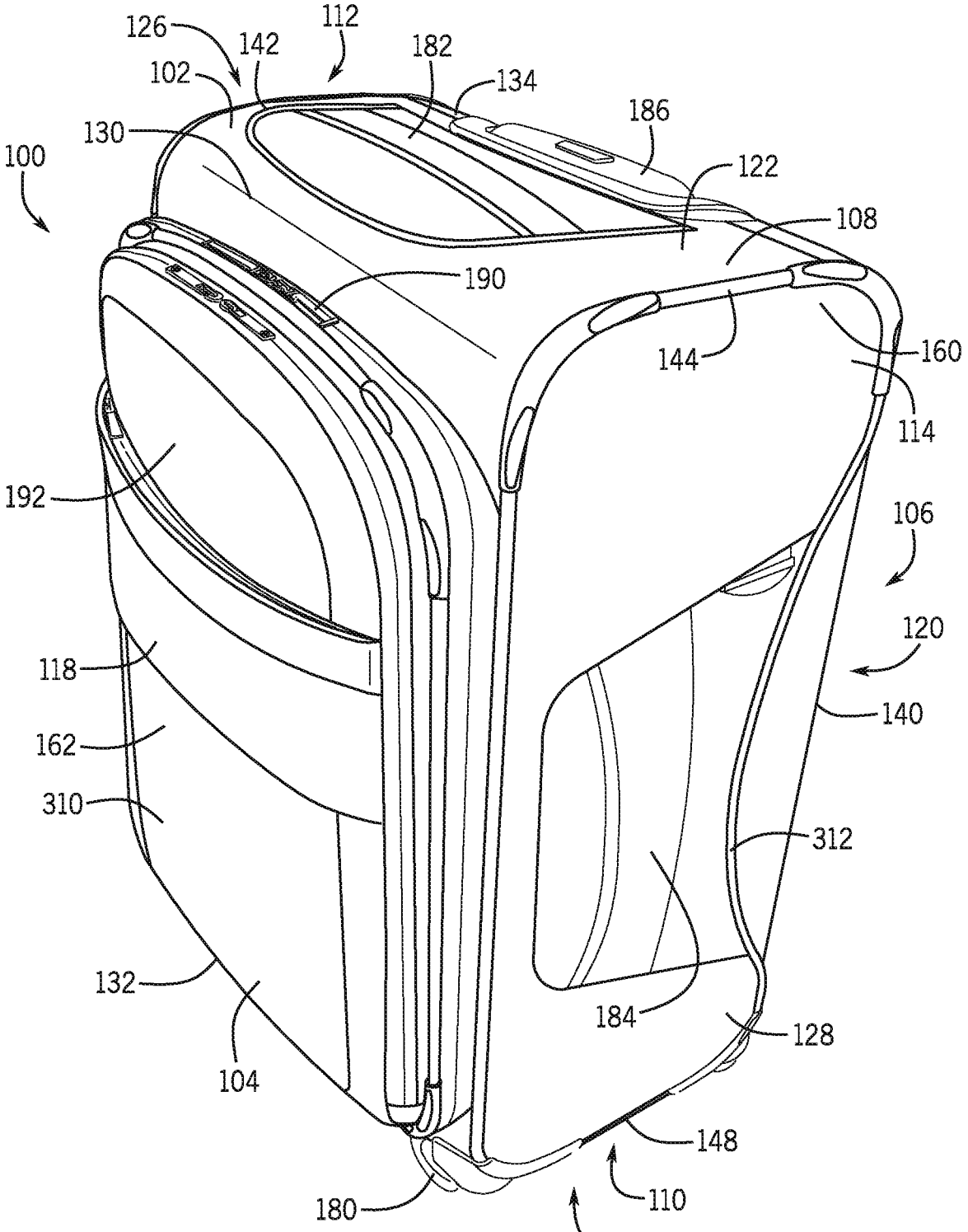
FIG. 1 is a front isometric view of a luggage article according to some examples of the present disclosure.
Figure 2:
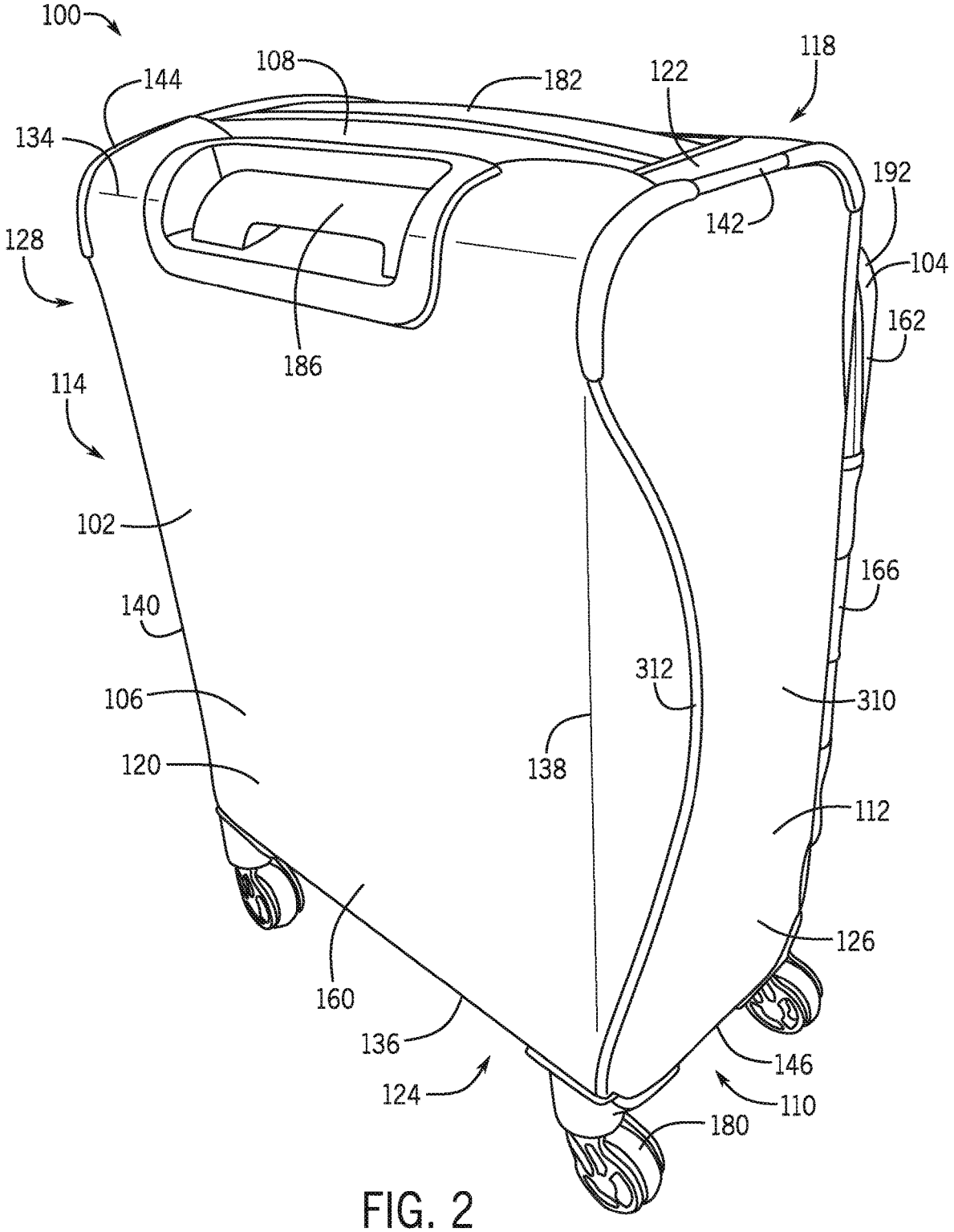
FIG. 2 is a rear isometric view of the luggage article of FIG. 1.

FIG. 1 is a front isometric view of a luggage article 100 according to some examples of the present disclosure. FIG. 2 is a rear isometric view of the luggage article 100. Referring to FIGS. 1 and 2, the luggage article 100 includes a housing 102 formed from a plurality of walls or panels (hereinafter "panels" for the sake of convenience without intent to limit) defining an internal storage volume in which to carry a user's belongings. In one example, the housing 102 may be formed from opposing front and rear panels 104, 106 and a plurality of side panels extending between the front and rear panels 104, 106. For example, the luggage article 100 may include opposing top and bottom panels 108, 110 and opposing left and right side panels 112, 114 that collectively define the housing 102 in combination with the front and rear panels 104, 106. The various panels may be formed from softside material, hardside material, or many combination thereof (such as for instance a hybrid luggage case). The various panels may be configured or arranged to provide a desired size and shape of the housing 102. For example, the various panels may be sized and shaped such that the luggage article 100 is taller than it is wide, wider than it is deep, or the like.

The luggage article 100 may include a plurality of sides defining the geometric shape of the housing 102. For instance, the luggage article 100 may include opposing front and rear sides 118, 120, opposing top and bottom sides 122, 124, and opposing left and right sides 126, 128, that collectively define a cuboid shape of the luggage article 100. The luggage article defines a length, which is generally along the long dimension of the left, right front and rear sides. Depending on the particular application, each side may be defined by or covered by a corresponding panel. For instance, the front side 118 may be defined by or covered by the front panel 104, the rear side 120 may be defined by or covered by the rear panel 106, the top side 122 may be defined by or covered by the top panel 108, the bottom side 124 may be defined by or covered by the bottom panel 110, the left side 126 may be defined by or covered by the left side panel 112, and the right side 128 may be defined by or covered by the right side panel 114.

In some examples, at least one side of the luggage article 100 may be defined or covered by a plurality of panels. For instance, the top side 118 of the luggage article 100 may be defined by or covered by the top panel 108 and at least one other panel of the housing 102 (such as at least one of the front panel 104, the rear panel 106, the left side panel 112, and the right side panel 114). Similarly, the right side 128 of the luggage article 100 may be defined by or covered by the right side panel 114 and at least one other panel of the housing 102 (such as at least one of the front panel 104, the rear panel 106, the top panel 108, and the bottom panel 110). In like manner, the left side 126 of the luggage article 100 may be defined by or covered by the left side panel 112 and at least one other panel of the housing 102 (such as at least one of the front panel 104, the rear panel 106, the top panel 108, and the bottom panel 110). The front, rear, and bottom sides 118, 120, 124 of the luggage article 100 may be configured similarly. In this manner, any one panel may extend on two or more sides of the luggage article 100. For instance, the rear panel 106 may extend on the rear side 120 and both the left and right sides 126, 128 of the luggage article 100. In some examples, the right side panel 114 may extend on the right and top sides 128, 122 of the luggage article 100 (see FIG. 7). Similarly, the left side panel 112 may extend on the left and top sides 126, 122 of the luggage article 100.

Any two adjacent sides of the luggage article 100 may intersect to define an edge of the housing 102. For example, the intersection of the front side 118 and the top side 122 may define a top front edge 130 of the housing 102. The intersection of the front side 118 and the bottom side 124 may define a bottom front edge 132 of the housing 102. Similarly, the intersections of the rear side 120 and the top, bottom, left, and right sides 122, 124, 126, 128 may define a top rear edge 134, a bottom rear edge 136, a left rear edge 138, and a right rear edge 140, respectively, of the housing 102. In like manner, the intersections between the top side 122 and the left and right sides 126, 128 may respectively define top left and right edges 142, 144 of the housing 102, and the intersections between the bottom side 124 and the left and right sides 126, 128 may respectively define bottom left and right edges 146, 148 of the housing 102.

In some examples, at least one of the panels may wrap around an edge of the housing 102 to extend over a plurality of sides of the luggage article 100. For example, as explained more fully below, the rear panel 106 may wrap around at least one of the left rear edge 138 and a right rear edge 140 of the housing 102 to extend over the rear side 120 and at least one of the left and right sides 126, 128 of the luggage article 100. Additionally or alternatively, the right side panel 114 may wrap around the top right edge 144 of the housing 102 to extend over the right and top sides 128, 122 of the luggage article 100. Similarly, the left side panel 112 may wrap around the top left edge 142 of the housing 102 to extend over the left and top sides 126, 122 of the luggage article 100, as detailed below.

With continued reference to FIGS. 1 and 2, the luggage article 100 may include a base 160 and a lid 162 defined by a line of separation 164. The luggage article 100 may be transformable between different configurations, such as between a closed configuration and an open configuration. For example, the lid 162 may be hingedly coupled to the base 160 by a hinge structure 166 or similar mechanism to allow selective positioning of the lid 162 relative to the base 160. In such examples, the lid 162 may be pivoted towards or away from the base 160 to close or open the luggage article 100, respectively. The lid 162, which may be referred to as a first luggage portion or section, may be defined by one or more panels. For example, the lid 162 may be defined by the front panel 104, either entirely or in part. In some examples, the lid 162 may be defined by the front panel 104 and at least portions of the top, bottom, left side, and/or right side panels 108, 110, 112, 114 such that the lid 162 includes sidewall portions. In like manner, the base 160, which may be referred to as a second luggage portion or section, may be defined by one or more panels. For instance, the base 160 may be defined by the rear panel 106, either entirely or in part. Similar to the lid 162, the base 160 may be defined by the rear panel 106 and at least portions of the top, bottom, left side, and right side panels 108, 110, 112, 114 such that the base 160 includes sidewall portions. In such examples, the sidewall portions of the base 160 may define the top, bottom, left side, and right side panels 108, 110, 112, 114 in combination with the sidewall portions of the lid 162. In some examples, the base 160 may be defined by a portion of the front panel 104. The hinge structure 166 may be a fabric strip, a piano hinge, a living hinge, spaced-apart discrete hinges, a zipper structure, an articulating joint made of elastomeric material, or other suitable structure arranged to allow selective positioning of the lid 162 relative to the base 160 from fully closed to fully open.

The luggage article 100 illustrated in FIGS. 1 and 2 is an upright spinner case, such as a softside luggage case, but may be any type of luggage article, such as a purse, a bag, a container, a backpack, etc. In like manner, the housing 102 of the luggage article 100 may be formed at least partially from softside material, entirely from softside material, or in a hybrid construction of softside material and hardside material. In some examples, the luggage article 100 may include one or more support members 180 to support the luggage article 100 against a support surface (e.g., against the ground). The support members 180, which may be a foot, a fixed wheel assembly, a spinner wheel assembly, or any combination thereof, may be associated with any suitable panel, such as connected to at least the bottom panel 110. In one example, the luggage article 100 may include a plurality of wheels, such as a plurality of spinner wheels, mounted on the bottom panel 110. In some examples, the luggage article 100 may also include one or more handles. For example, the luggage article 100 may include a top carry handle 182 coupled to the top panel 108 and/or a side carry handle 184 coupled to one of the left and right side panels 112, 114 (e.g., to the right side panel 114). As shown, a retractable tow handle 186 may be extendable from the top panel 108 (such as from adjacent the top rear edge 134) of the luggage article 100.

The luggage article 100 may include a closure mechanism 190 to selectively secure the lid 162 and the base 160 together. The closure mechanism 190 may be positioned along or adjacent the line of separation 164 between the lid 162 and the base 160 (such as along a periphery of the lid 162) to allow selective actuation for opening and closing of the luggage article 100. In an open configuration, the closure mechanism 190 is disengaged along substantially the entire length of the line of separation 164, thereby allowing the lid 162 and the base 160 to pivot relative to each other to any amount from partially open to fully open. In a closed configuration, the closure mechanism 190 is engaged along at least a portion of the length of the line of separation 164 to limit relative movement between the lid 162 and the base 160. The closure mechanism 190 may be any suitable closure device or system. For instance, the closure mechanism 190 may be a zip closure or attachment, though other types of closure devices are contemplated, including one or more latches spaced along the line of separation 164.

In one example, the closure mechanism 190 may extend along at least three edges of the lid 162, the hinge structure 166 being positioned on a remaining edge of the lid 162. In this manner, the lid 162 may be defined as a door panel 192. As one example, the front panel 104 may at least partially define the door panel 192. As shown in FIG. 1, the door panel 192 may be hingedly coupled to one of the top panel 108, the bottom panel 110, the left side panel 112, and the right side panel 114. In such examples, the door panel 192 may be releasably connected to the other of the top panel 108, the bottom panel 110, the left side panel 112, and the right side panel 114.

Figure 3:
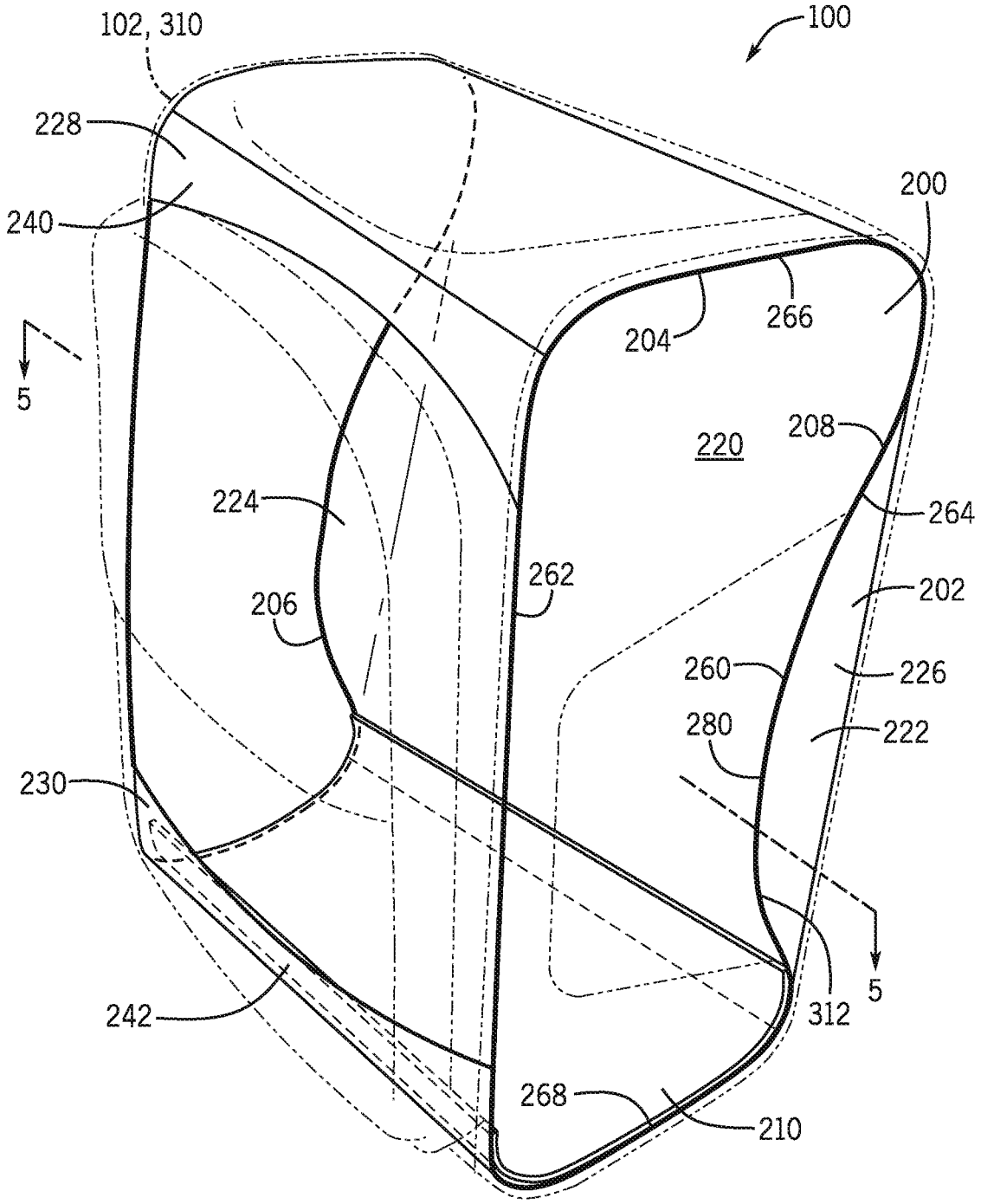
FIG. 3 is an isometric view of the luggage article of FIG. 1 and showing an internal frame structure with an outer housing shown in dash for illustration purposes according to some examples of the present disclosure.
Figure 4:
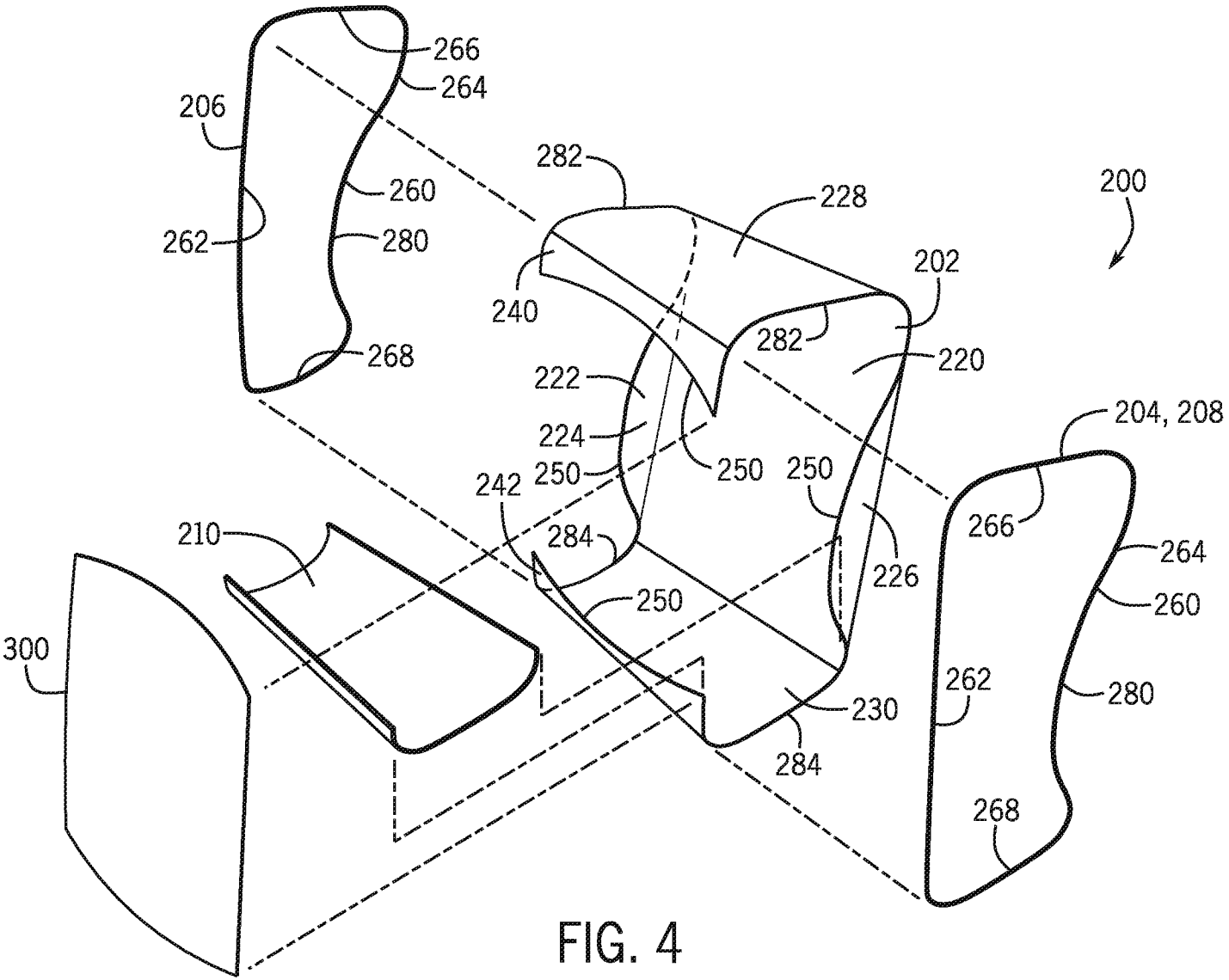
FIG. 4 is an exploded view of the frame structure of FIG. 3 without the outer housing.
Figure 5:
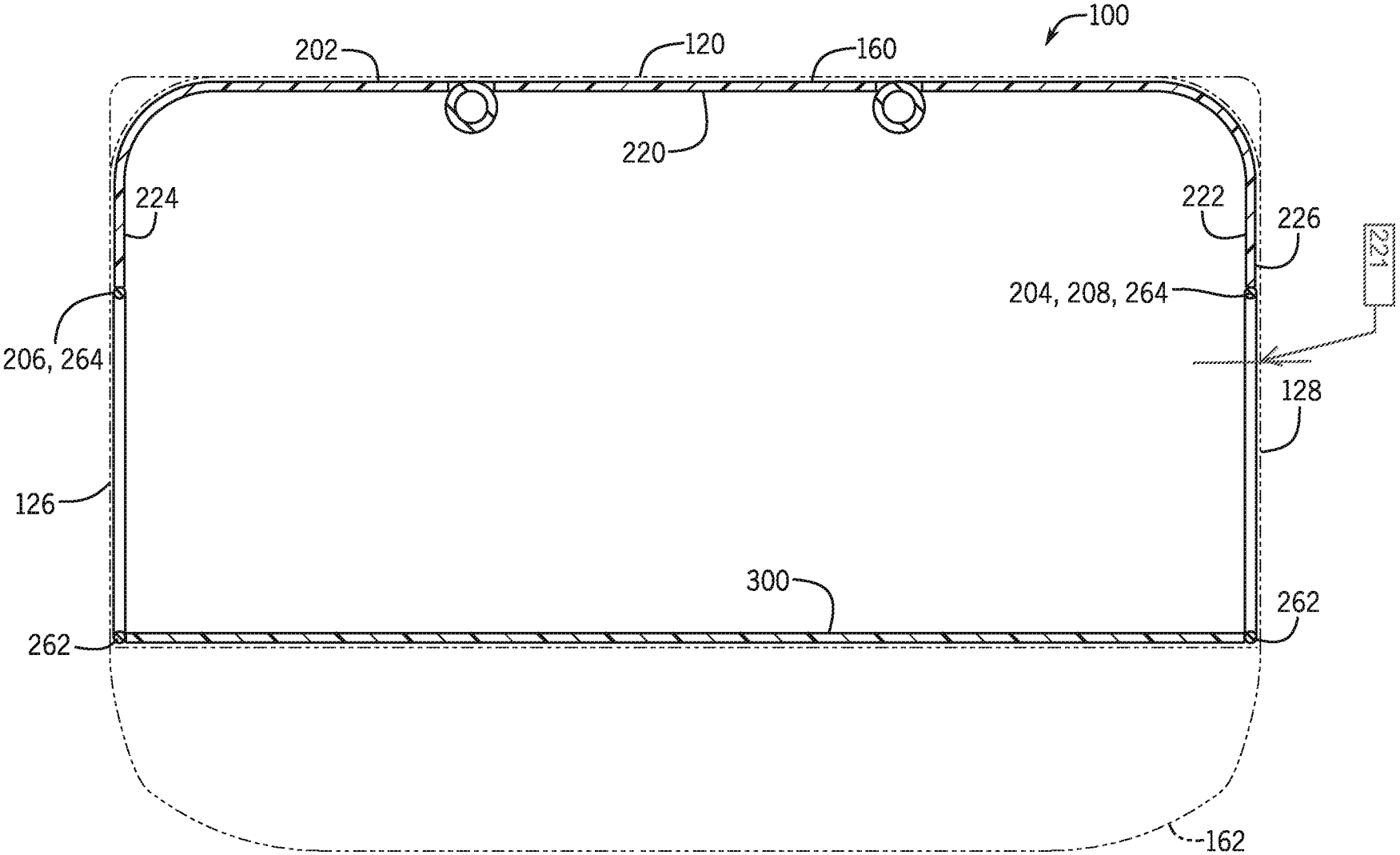
FIG. 5 is a schematic cross-sectional view of the luggage article of FIG. 1 and taken along line 5-5 of FIG. 3.
Figure 6:
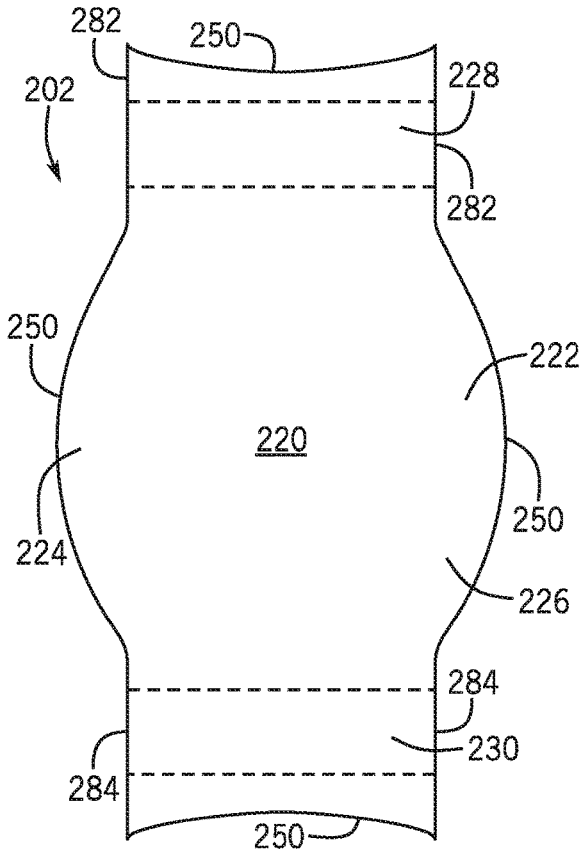
FIG. 6 shows a reinforcing board in an unfolded, flat configuration according to some examples of the present disclosure.
Figure 7:
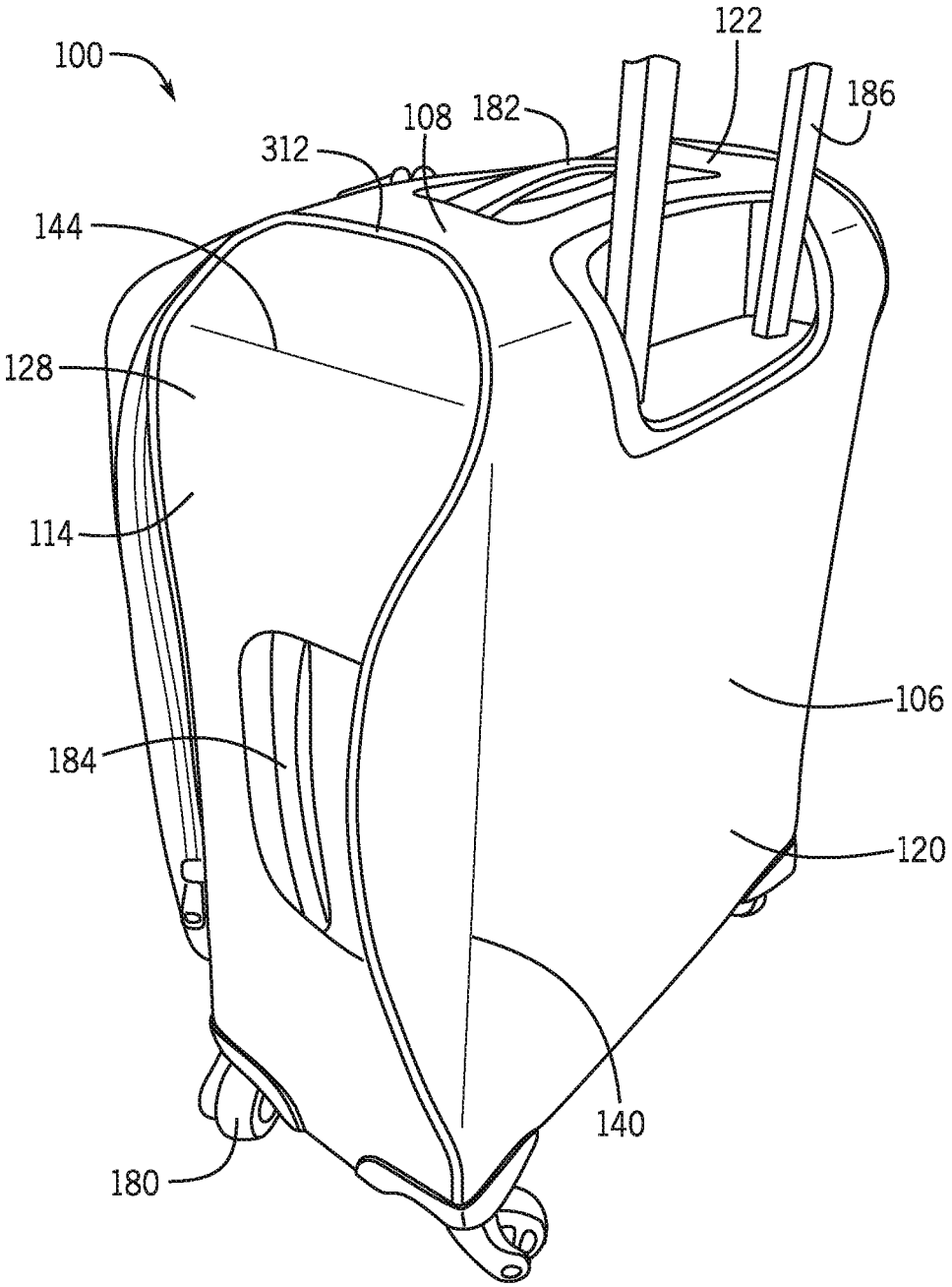
FIG. 7 is a rear isometric view of an additional luggage article according to some other examples of the present disclosure.
Figure 8:
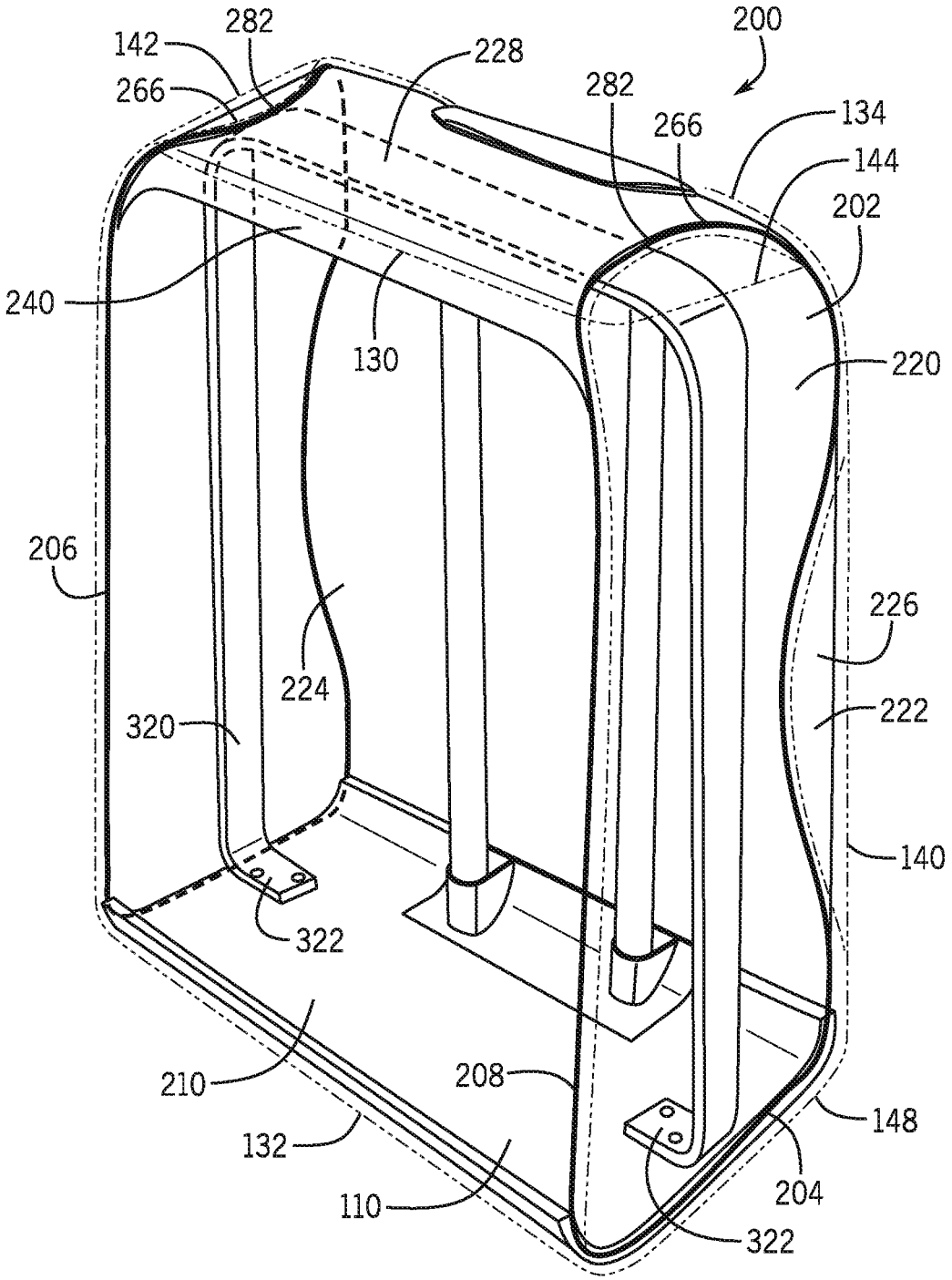
FIG. 8 is an isometric view of a frame structure of the luggage article of FIG. 7 according to some examples of the present disclosure with certain features of the luggage article removed for illustration purposes.
Figure 9:
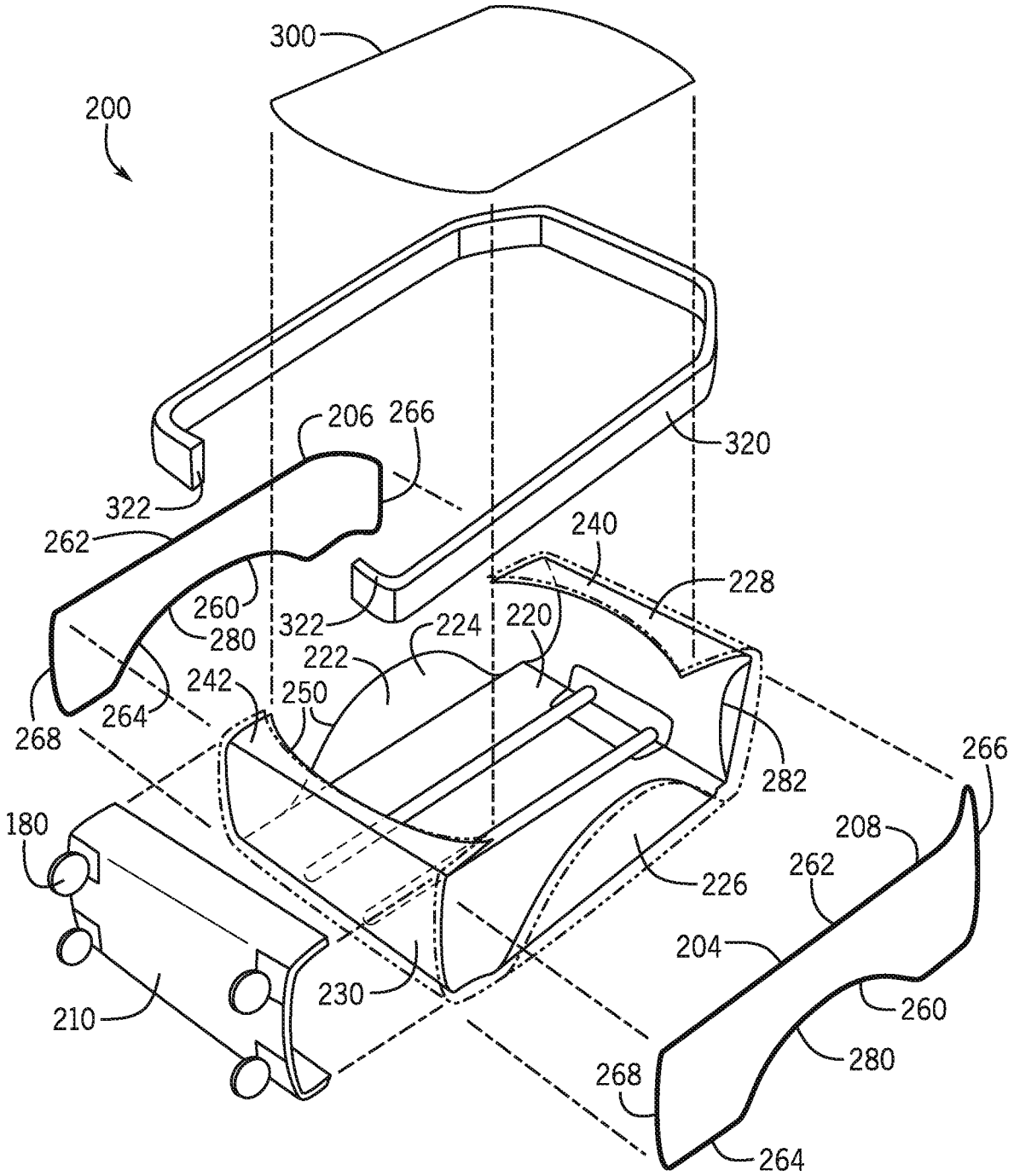
FIG. 9 is an exploded view of the frame structure of FIG. 8.
Figure 10:
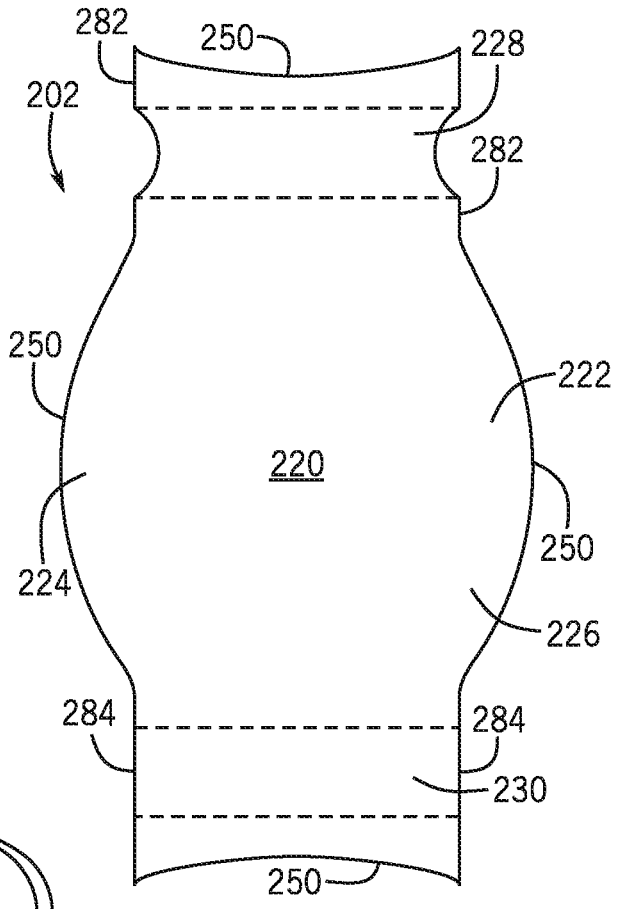
FIG. 10 shows a reinforcing board in an unfolded, flat configuration according to some examples of the present disclosure, such as the examples shown in FIGS. 7 and 8.

FIG. 3 is an isometric view of the luggage article 100 and showing an internal frame structure within an outer housing shown in dash for illustration purposes. FIG. 4 is an exploded view of the frame structure of FIG. 3. FIG. 5 is a schematic cross-sectional view of the luggage article 100 taken along line 5-5 of FIG. 3. FIG. 6 is an elevation view of a reinforcing board in an unfolded, flat configuration according to some examples of the present disclosure. FIG. 7 is a rear isometric view of an additional luggage article according to some examples of the present disclosure. FIG. 8 is an isometric view of a frame structure of the luggage article of FIG. 7 according to some examples of the present disclosure. FIG. 9 is an exploded view of the frame structure of FIG. 8. FIG. 10 is an elevation view of the reinforcing board 202 in an unfolded, flat configuration according to some examples of the present disclosure. Referring to FIGS. 3-10, the luggage article 100 includes a frame structure 200 supporting the housing 102 and providing shape to the luggage article 100. For example, the frame structure 200 may be operable to maintain a degree of rigidity of one or more panels of the housing 102 to the extent needed for holding a shape of the housing 102 and supporting a load therein when in use. The frame structure 200, which may be positioned at least partially internal to the housing 102, may include various elements, either interconnected together, positioned separately from one another, or a combination of both. For example, the frame structure 200 may include one or more pan assemblies, one or more frame assemblies, one or more reinforcing panels or boards, or any combination thereof to define a skeletal framework of the luggage article 100.

In one example, the frame structure 200 includes a reinforcing board 202 and at least one closed loop frame 204. In some examples, the frame structure 200 may include a plurality of closed loop frames 204, such as a first closed loop frame 206 and a second closed loop frame 208. The frame structure 200 may also include a bottom pan assembly 210. As described below, each closed loop frame 204 may support one of the side panels of the housing 102. For example, the closed loop frame 204 may support one of the opposing left and right side panels 112, 114. In examples with first and second closed loop frames 206, 208, the first closed loop frame 206 may support the left side panel 112 of the housing 102, and the second closed loop frame 208 may support the right side panel 114 of the housing 102, as explained more fully below. Except as otherwise noted, the description of the closed loop frame 204 below is applicable to the first and second closed loop frames 206, 208, either individually or collectively.

The reinforcing board 202 may be arranged to extend over or along a plurality of sides of the housing 102. For example, the reinforcing board 202 may include a plurality of portions extending over or along respective sides of the housing 102. Depending on the particular application, "over" means "above" or "covering" or simply along, whether on the outside or inside of the luggage article 100, or as a layer or layers in a plurality of layers forming the cover of the luggage article 100. In one example, the reinforcing board 202 may include a central portion 220 and at least one side portion 222 extending therefrom. As illustrated, the reinforcing board 202 may include first and second side portions 224, 226 extending from opposing lateral sides of the central portion 220. The first and second side portions 224, 226 may be formed integrally with the central portion 220. In some examples, the reinforcing board 202 may include a top portion 228 extending from a top of the central portion 220. Additionally or alternatively, the reinforcing board 202 may include a bottom portion 230 extending from a bottom of the central portion 220. In such examples, the central portion 220 may extend over or along the rear side 120 of the housing 102. For example, the central portion 220 may extend over or along substantially all of the rear side 120 of the housing 102. The first and second side portions 224, 226, which may be referred to as wings, may extend from the central portion 220 over or along at least part of the opposing left and right sides 126, 128, respectively, of the housing 102. For instance, the first and second side portions 224, 226 of the reinforcing board 202 may be resiliently bent from the central portion 220 over or along at least part of the opposing left and right sides 224, 226. Depending on the particular application, the first and second side portions 224, 226 may extend over or along only a rear portion of the left and right sides 126, 128 adjacent to the rear side 120. The top portion 228 may be resiliently bent to extend from the central portion 220 over or along at least part of the top side 122. Depending on the particular application, the top portion 228 may be bent to extend beyond the top front edge 130 of the housing 102 to form a top lip 240 extending over or along a part of the top of the front panel 104. Similarly, the bottom portion 230 may be resiliently bent to extend from the central portion 220 over or along at least part of the bottom panel 110. Like the top portion 228, the bottom portion 230 may be bent to extend beyond the bottom front edge 132 of the housing 102 to form a bottom lip 242 extending over or along a part of the bottom of the front panel 104. As shown, the bottom portion 230 may be positioned outwardly of the bottom pan assembly 210. Alternatively, the bottom portion 230 may be positioned inwardly of the bottom pan assembly 210. The top portion 228 and/or the bottom portion 230 may be formed integrally with the central portion 220. The side portions of the reinforcing board may extend along the sides at least as far as the centerline 221 (FIG. 5) of the sides. Alternatively, the side portions of the reinforcing board may extend along the sides not further than the centerline of the sides.

The reinforcing board 202 may include many shapes and configurations. For instance, the reinforcing board 202 may be substantially planar, linear, arcuate, or curved, among others, either collectively or in part. As shown, the first side portion 224 of the reinforcing board 202 may be bent in a curve around the left rear edge 138 of the housing 102 to at least partially extend over or along the left side 126. When bent around the left rear edge 138 of the housing 102, at least a portion of the first side portion 224 may extend in the plane of the left side panel 112. In like manner, the second side portion 226 of the reinforcing board 202 may be bent in a curve around the right rear edge 140 of the housing 102 to at least partially extend over or along the right side 128. Like the first side portion 224, when bent around the right rear edge 140 of the housing 102, at least a portion of the second side portion 226 may extend in the plane of the right side panel 114. The curvature of the first and second side portions 224, 226 at their respective interface with the central portion 220 may be smooth and continuous to provide a rounded shape to the right and left rear edges 140, 138 of the housing 102. In one non-limiting example, the radius of curvature of the reinforcing board 202 at the right and left rear edges 140, 138 may be between about 1.25 inches and about 2.25 inches, but may be larger or smaller. In other examples, the curvature of each of the side portions 224, 226 at the respective interface with the central portion 220 may be a series of straight sections angled relative to one another to form a curve when taken together. Additionally, the curve formed at the interface between the central portion 220 and either one or both of the side portions 224, 226 may have a continuous radius of curvature, or an increasing or decreasing radius of curvature.

The curved nature of the reinforcing board 202 around the edges of the housing 102 may limit undesired failure of the luggage article 100 when dropped or otherwise impacted on edge. For instance, by curving around the respective edges of the housing 102, the reinforcing board 202 may distribute impact forces throughout the reinforcing board 202 and/or other portions of the frame structure 200 to limit failure of the housing 102 during operation. For instance, some traditional luggage case construction methods include straight edges at the intersections between adjacent panels. Though sometimes protected by piping or beading, these straight edges can be a weak point of construction and sometimes fail through abrasion and/or seam failure. This is especially true for the edges running along the back side of a luggage case. The present disclosure, however, reduces or eliminates hard edges along the edges of the luggage article 100 by creating a radius in the middle of the edge span. Because no point of an arch is weaker than any other, impacts to these areas are not focused on a sharp corner, and may result in less damage. The curved nature of the reinforcing board 202 may also create tension forces in the framing of the luggage article 100 that creates resiliency and allows the housing 102 to spring back into shape after impact.

The top and bottom portions 228, 230 of the reinforcing board 202 may be arranged similar to the first and second side portions 224, 226. Specifically, the top portion 228 of the reinforcing board 202 may curve around the top rear edge 134 to at least partially extend over or along the top side 122 of the housing 102. In such examples, at least part of the top portion 228 of the reinforcing board 202 may extend in the plane of the top panel 108. In one example, the top portion 228 of the reinforcing board 202 may curve around both the top rear edge 134 and the top front edge 130 to at least partially extend over or along the front and top sides 118, 122 of the housing 102. In such examples, at least part of the top portion 228 of the reinforcing board 202 may also extend in the plane of the front panel 104. The bottom portion 230 may be positioned similarly. For instance, the bottom portion 230 of the reinforcing board 202 may curve around the bottom rear edge 136 to at least partially extend over or along the bottom side 124 of the housing 102. In such examples, at least part of the bottom portion 230 of the reinforcing board 202 may extend in the plane of the bottom panel 110. In some examples, the bottom portion 230 of the reinforcing board 202 may curve around both the bottom rear edge 136 and the bottom front edge 132 to at least partially extend over or along the front and bottom sides 118, 124 of the housing 102. In such examples, at least part of the bottom portion 230 of the reinforcing board 202 may also extend in the plane of the front panel 104.

With continued reference to FIGS. 3-10, each of the first side portion 224, the second side portion 226, the top portion 228, and the bottom portion 230 of the reinforcing board 202 may include a distal edge 250. As shown, the distal edges 250 may be curved along their lengths. As one example, the distal edges 250 of the first and second side portions 224, 226 may be convexly curved. The distal edges 250 of the top and bottom portions 228, 230 may be shaped similarly or different. For instance, the distal edges 250 of the top and bottom portions 228, 230 may be concavely curved. As explained below, the distal edges 250 may be shaped for alignment with other portions of the luggage article 100. For example, the distal edges 250 may be shaped to align with other portions of the frame structure 200 described below. Though shown and described as curved along their lengths, the distal edges 250 may be straight or substantially straight depending on the particular application. In such examples, each distal edge 250 may extend in the plane of a respective panel of the housing 102. For instance, the distal edges 250 of the first and second side portions 224, 226 may extend generally in the planes of the left and right side panels 112, 114, respectively. Additionally or alternatively, the distal edges 250 of the top and bottom portions 228, 230 may extend generally in the plane of the front panel 104.

The reinforcing board 202 may take the form of a sheet of material which may form a panel structure. The reinforcing board may be rigid or semi-rigid, the rigid sheet of material being more difficult to bend than the semi-rigid material. In one example, the sheet of material may be resilient to bend and when released retake its original form, or may be semi-resilient so as to bend and when released to take a shape similar to but not the same as its original form. The sheet may be a single layer, or may be more than one layer, and/or additionally may be structural sheet, such as for example having a honeycomb, ribbed, corrugated, or other structure. The reinforcing board may be relatively thin, such as having a thickness dimension ranging approximately from 0.5 to 2.5 mm. The reinforcing board may be formed from many materials to provide a desired characteristic. As one example, the reinforcing board 202 may be formed from material allowing the reinforcing board 202 to resiliently deform. Such material selection may limit undesired failure of the luggage article 100 when dropped or otherwise impacted. For instance, when impacted by an impact force, the resilient nature of the reinforcing board 202 may allow the housing 102 to bend or flex during operation. As one example, the reinforcing board 202 may be formed from PE or PP material, or may be formed of a combination of materials, though many suitable materials are contemplated.

The closed loop frame 204 will now be discussed in more detail. As shown, the closed loop frame 204 may include a frame portion 260 matching and aligned with a corresponding distal edge 250 of the reinforcing board 202. For example, the frame portion 260 of the first closed loop frame 206 may match and align with the distal edge 250 of the first side portion 224 of the reinforcing board 202. In like manner, the frame portion 260 of the second closed loop frame 208 may match and align with the distal edge 250 of the second side portion 226 of the reinforcing board 202. The closed loop frame 204 may include a front section 262 extending adjacent to the front panel 104 and a rear section 264 extending adjacent to the rear panel 106. The closed loop frame 204 may include top and bottom sections 266, 268 extending between the front and rear sections 262, 264 and respectively adjacent to the top and bottom panels 108, 110. Specifically, the top and bottom sections 266, 268 may extend from opposing ends of the front section 262. In such examples, the rear section 264 may extend from the top and bottom sections 266, 268. For instance, the rear section 264 may connect ends of the top and bottom sections 266, 268 together.

The closed loop frame 204 may include many shapes and configurations. For instance, the closed loop frame 204 may include a nonrectangular shape to match and align with the reinforcing board 202. As one example, the rear section 264 of the closed loop frame 204 may include a shape matching and aligned with the distal edge 250 of first side portion 224 or the second side portion 226 of the reinforcing board 202. Specifically, the rear section 264 may include a central section 280 extending, and preferably curved or scalloped, inwardly toward the front section 262 to match and align with the curved shape of the distal edge 250 of the first side portion 224 or the second side portion 226 of the reinforcing board 202. As shown in FIGS. 3 and 4, the front, top, and bottom sections 262, 266, 268 of the closed loop frame 204 may be generally linear between the front and rear sections 262, 264. The top and bottom sections 266, 268 may extend substantially perpendicularly from the front section 262.

Referring to FIGS. 8 and 9, the top and bottom sections 266, 268 of the closed loop frame 204 may include a shape generally matching and aligned with the top and bottom portions 228, 230 of the reinforcing board 202. For instance, the top section 266 of the closed loop frame 204 may include a shape matching and aligned with a side edge 282 of the top portion 228 of the reinforcing board 202. Similarly, the bottom section 268 of the closed loop frame 204 may include a shape matching and aligned with a side edge 284 of the bottom portion 230 of the reinforcing board 202. The side edges 282 of the top portion 228 and/or the side edges 284 of the bottom portion 230 of the reinforcing board 202 may curve inwardly toward an opposing side of the housing 102. In such examples, the top section 266 of the closed loop frame 204 may curve outwardly (e.g. away from a bottom section 268) of the closed loop frame 204, to match and align with the inwardly curved side edge 282 of the top portion 228. More particularly, the top section 266 of the closed loop frame 204 may be defined by a short edge, and may curve around the top left edge 142 or the top right edge 144 of the housing 102 to extend at least partially over or along the top side 122. The bottom section 268 of the closed loop frame 204 may be configured similarly to match and align with inwardly extending side edges 284 of the bottom portion 230 of the reinforcing board 202.

With reference to FIGS. 3, 4, 8, and 9, the closed loop frame 204 may be coupled or otherwise joined to the reinforcing board 202. For example, the rear section 264 of the closed loop frame 204 may be connected to the distal edge 250 of the first side portion 224 or to the distal edge 250 of the second side portion 226 of the reinforcing board 202, such as by stitching, a piping or bead structure, or otherwise. Similarly, the top section 266 of the closed loop frame 204 may be connected to the side edge 282 of the top portion 228 of the reinforcing board 202. The bottom section 268 of the closed loop frame 204 may be connected to the side edge 284 of the bottom portion 230 of the reinforcing board 202. In embodiments where the top portion 228 of the reinforcing board 202 extends around the top front edge 130 of the housing 102, the front section 262 of the closed loop frame 204 may be connected to the side edge 282 of the top portion 228. In embodiments where the bottom portion 230 of the reinforcing board 202 extends around the bottom front edge 132 of the housing 102, the front section 262 of the closed loop frame 204 may be connected to the side edge 284 of the bottom portion 230.

The closed loop frame 204 may include many levels of desired rigidity or flexibility. For instance, the closed loop frame 204 may be designed to be resiliently flexible to allow resilient deformation or deflection of the closed loop frame 204 during use. The resilient characteristic of the closed loop frame 204 may allow the closed loop frame 204 to absorb impacts to the luggage article 100 and/or allow the closed loop frame 204 to flex to accommodate packing of contents within the luggage article 100. More specifically, as portions of the closed loop frame 204 are induced to deform or deflect, such as inwardly or outwardly, the closed loop frame 204 may provide an opposingly directed biasing force resisting such deformation or deflection. The resilient characteristic of the closed loop frame 204 may be provided by the material properties of the front section 262, the rear section 264, the top section 266, and/or the bottom section 268, by the shape of the respective frame sections, by the connection structure between the various frame sections, or a combination thereof.

The closed loop frame 204 may be formed in many configurations. For example, the closed loop frame 204 may be formed as a continuous wire loop. Additionally or alternatively, the closed loop frame 204 may include one or more elongate elements connected together at adjacent corners, and/or along the length of the elongate elements if desired. More particularly, the front, rear, top, and bottom sections 262, 264, 266, 268 of the closed loop frame 204 may be separate elements coupled together, such as elongate rods, wires, or pultrusions. As noted above, the front, rear, top, and bottom sections 262, 264, 266, 268 may extend in a straight or a substantially straight line, may be curved along their lengths, or may include a combination of straight and curved segments.

Referring to FIGS. 3, 4, 8, and 9, the frame structure 200 of the luggage article 100 may include a panel frame 300 supporting the lid 162. To allow selective positioning of the lid 162 relative to the base 160, the panel frame 300 may be separate from any other element of the frame structure 200 to provide independent support of the lid 162. For instance, the panel frame 300 may be associated with the lid 162 (e.g., the door panel 192) to support the lid 162 irrespective and independent of the support provided to other portions of the housing 102.

The panel frame 300 may be defined in a closed loop. For example, the panel frame 300 may include one or more elongate elements connected together to define a closed loop frame structure. As shown, the panel frame 300 may form a generally rectangular shape with rounded corners, though the panel frame 300 may be formed in other suitable shapes, such as polygonal, elliptical, or circular, among others. The elongate elements may extend in a straight or a substantially straight line, may be curved along their lengths, or may include a combination of straight and curved segments. As shown, the distal edges 250 of the top and bottom portions 228, 230 of the reinforcing board 202 may be shaped to match and align with the panel frame 300. For example, the distal edges 250 of the top and bottom portions 228, 230 of the reinforcing board 202 may be concavely curved to match and align with convexly curved sections of the panel frame 300.

The panel frame 300 may be resiliently flexible in a manner similar to the closed loop frame 204. In one example, the panel frame 300 may be arranged to tension the door panel 192. For instance, the panel frame 300 may be outwardly biased against an inner periphery of the door panel 192 to suitably tension the door panel 192 for use. More specifically, the panel frame 300 may engage at least a portion of the inner periphery of the door panel 192 to create a tension force in the door panel 192.

Referring to FIGS. 1-3, the luggage article 100 may include other features for convenience. For example, depending on the particular application, the housing 102 may cover at least a portion of the frame structure 200. More specifically, the luggage article 100 may include an outer fabric cover 310 over at least part of the opposing left and right sides 126, 128 and the front side 118. In one example, the outer fabric cover 310 extends over all sides of the luggage article 100. The outer fabric cover 310 may include or otherwise define a fabric seam 312 aligned with the distal edges 250 of the first and second side portions 224, 226 of the reinforcing board 202. By positioning the fabric seam 312 along the distal edges 250 of the first and second side portions 224, 226 of the reinforcing board 202, the fabric seam 312 may be spaced away from the left and right rear edges 138, 140 to limit seam failure.

Referring to FIGS. 8 and 9, the frame structure 200 may include a brace 320 extending between opposing portions of the reinforcing board 202. For instance, the brace 320 may extend between the top and bottom portions 228, 230 of the reinforcing board 202 to limit deformation of the housing 102. For example, the brace 320 may limit inward deformation of the top and bottom portions 228, 230 towards each other. In some examples, the brace 320 may be coupled to the bottom pan assembly 210, such as via mechanical fasteners or otherwise. As shown, the brace 320 may be generally C-shaped, with terminal ends 322 of the brace 320 connected to the bottom panel 110 of the housing 102. The brace 320 may not extend continuously as one integral piece, but may instead be embodied in two portions. For example, one portion may be attached between the top portion and bottom portion (and/or bottom pan assembly) of the reinforcing board and extend along a left side of the luggage article, and/or a second portion may be attached between the top portion and the bottom portion (and/or the pan assembly) of the reinforcing board and extend along a right side of the luggage article. The brace or braces may be made of a strip of structured material, such as a honeycomb material, or other such material that may have sufficient structural properties to withstand the loads applied to a frame member of a luggage article.

Figure 12:
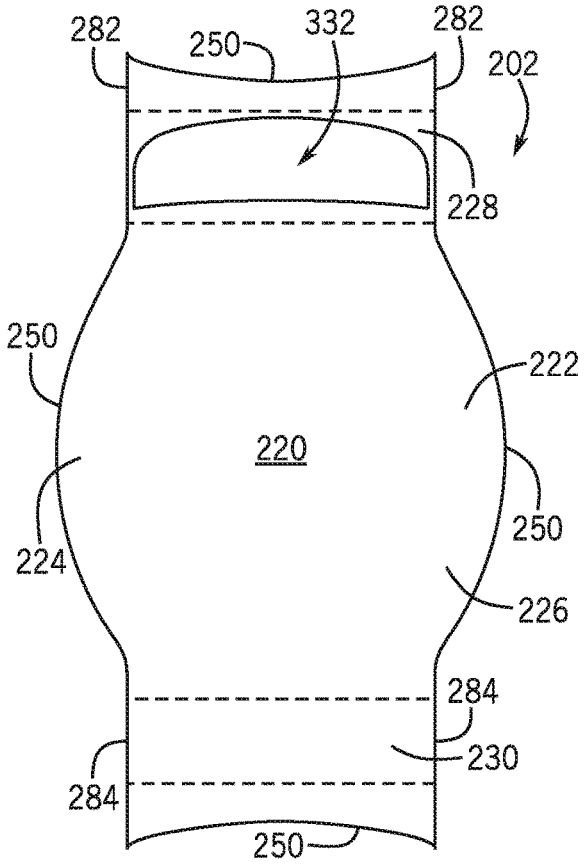
FIG. 12 shows a reinforcing board in an unfolded, flat configuration according to some examples of the present disclosure, such as the example shown in FIG. 11.
Figure 13:
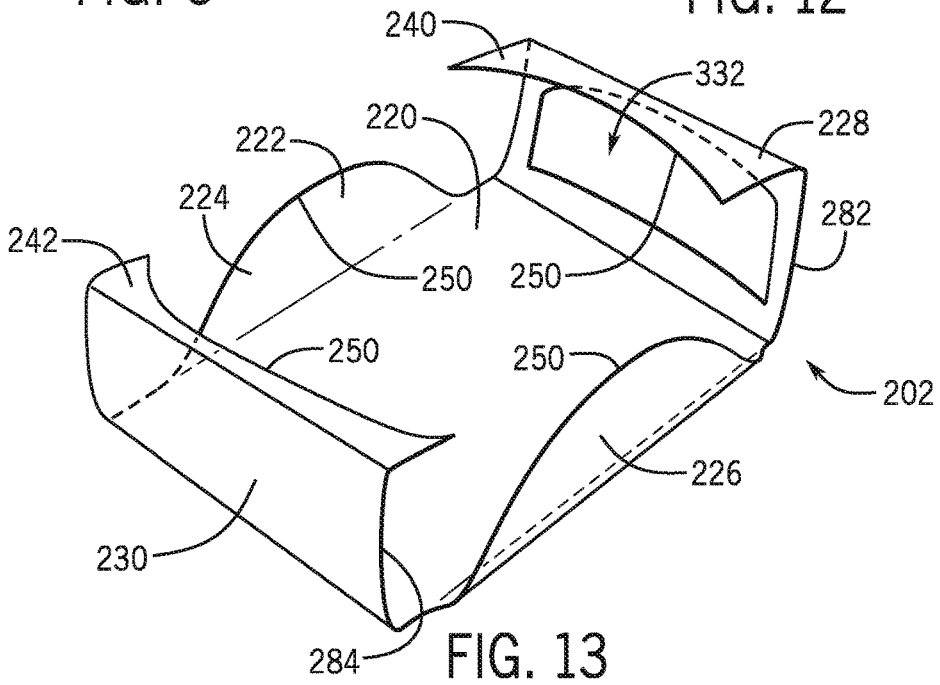
FIG. 13 is an isometric view of the reinforcing board of FIG. 12 in a folded configuration according to some examples of the present disclosure.
Figure 11:
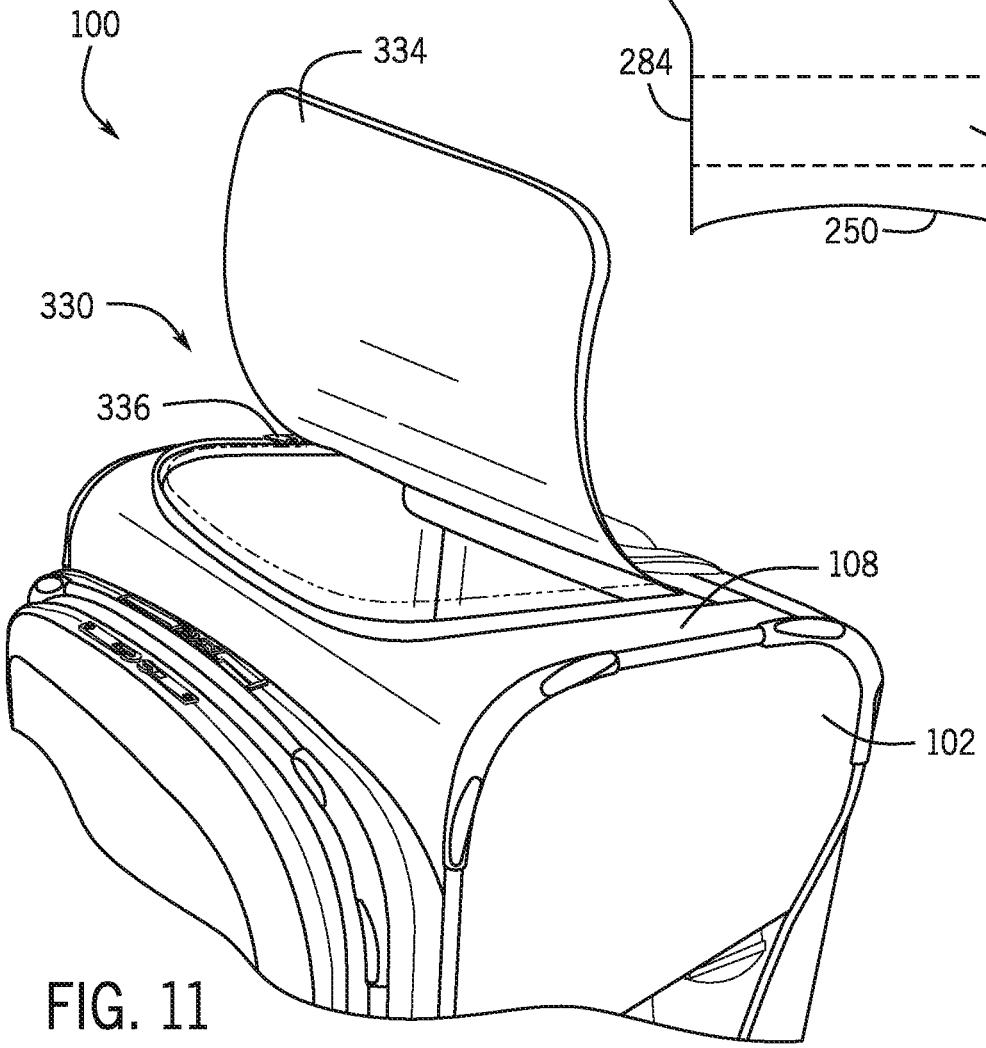
FIG. 11 is a fragmentary isometric view of an additional luggage article with a top pocket according to some examples of the present disclosure.

FIG. 11 is a fragmentary isometric view of the luggage article 100. FIG. 12 is an elevation view of the reinforcing board 202 in an unfolded, flat configuration according to some examples of the present disclosure. FIG. 13 is an isometric view of the reinforcing board 202 of FIG. 12 in a folded configuration according to some examples of the present disclosure. Referring to FIGS. 11-13, the luggage article 100 may include a top pocket 330 defined in the top panel 108 of the housing 102. In such examples, the reinforcing board 202 may be arranged to accommodate the top pocket 330. For instance, as shown in FIGS. 12 and 13, the top portion 228 of the reinforcing board 202 may include a cutout 332 defined therein. When the top portion 228 of the reinforcing board 202 is folded over or along the top side, the cutout 332 aligns with the top pocket 330 to allow selective positioning of contents therein. As shown in FIG. 11, the top pocket 330 may be selectively secured or covered by a flap 334. For example, the flap 334 may be releasably secured to the top panel 108 of the housing 102 via a zipper closure 336.

Figure 14:
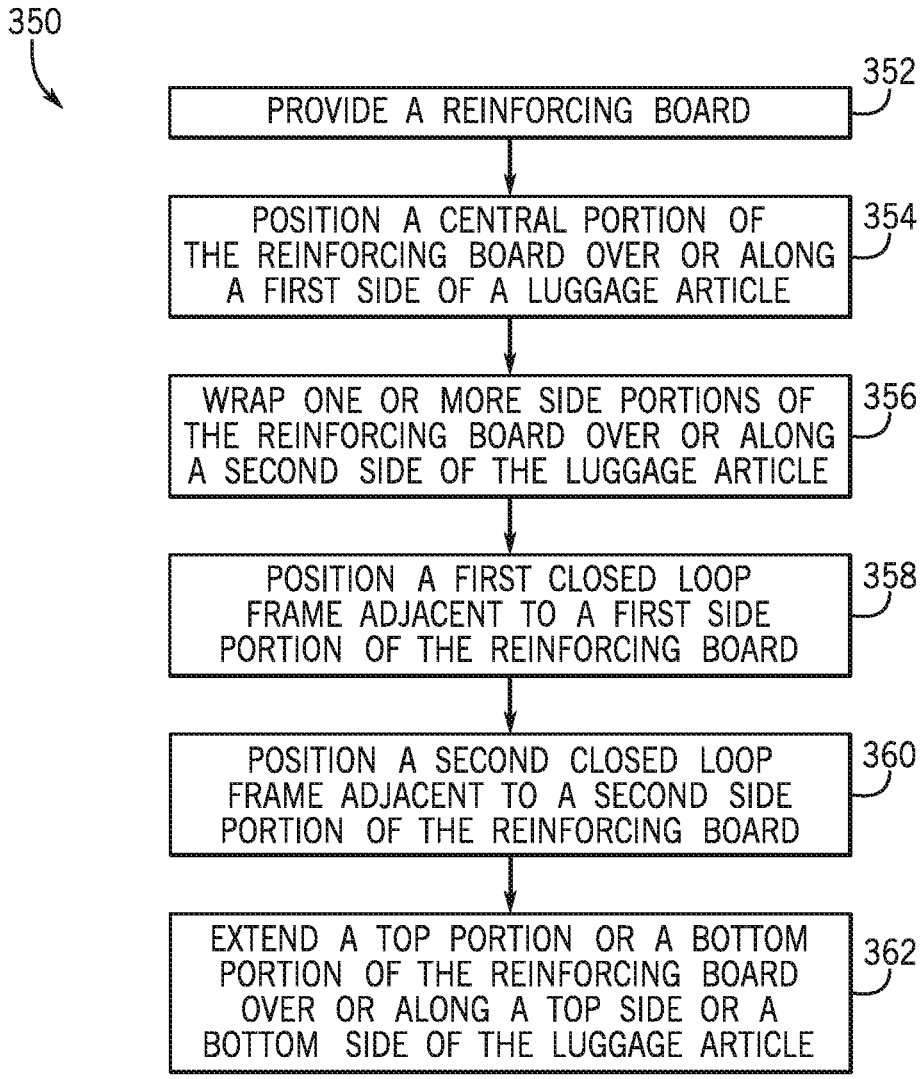
FIG. 14 is a flow chart illustrating a method of manufacturing a luggage article according to some examples of the present disclosure.

FIG. 14 is a flow chart illustrating a method 350 of manufacturing a luggage article, such as luggage article 100. Referring to FIG. 14, the method 350 includes providing the reinforcing board 202 (Block 352). The reinforcing board 202 may include the central portion 220 and one or more side portions 222 extending from the central portion 220. The one or more side portions 222 may include at least one of the first side portion 224, the second side portion 226, the top portion 228, and the bottom portion 230 of the reinforcing board 202. With continued reference to FIG. 14, the method 350 may include positioning the central portion 220 of the reinforcing board 202 over or along a first side of the luggage article 100 (Block 354), and wrapping the one or more side portions 222 of the reinforcing board 202 over or along a second side of the luggage article 100 adjacent to the first side (Block 356). For example, as described above, the central portion 220 may be positioned over or along the rear side of the housing 102. In such examples, the one or more side portions 222 of the reinforcing board 202 may be wrapped over or along the left side, the right side, the top side, and/or the bottom side of the housing 102. As shown in FIG. 14, the method 350 may also include positioning the closed loop frame 204 adjacent to the one or more side portions 222 of the reinforcing board 202 (Block 358). As detailed above, the closed loop frame 204 may include a frame portion 260 matching and aligned with the one or more side portions 222 of the reinforcing board 202. The closed loop frame 204 may be the first closed loop frame 206 positioned adjacent to the first side portion 224 of the reinforcing board 202.

With continued reference to FIG. 14, the method 350 may include positioning the second closed loop frame 208 adjacent to the second side portion 226 of the reinforcing board 202 (Block 360). The second closed loop frame 208 may include a frame portion 260 matching and aligned with the second side portion 226 of the reinforcing board 202. As shown in FIG. 14, the method 350 may include extending the top portion 228 or the bottom portion 230 of the reinforcing board 202 over or along the top side or the bottom side of the luggage article 100 (Block 362).

Figure 15:
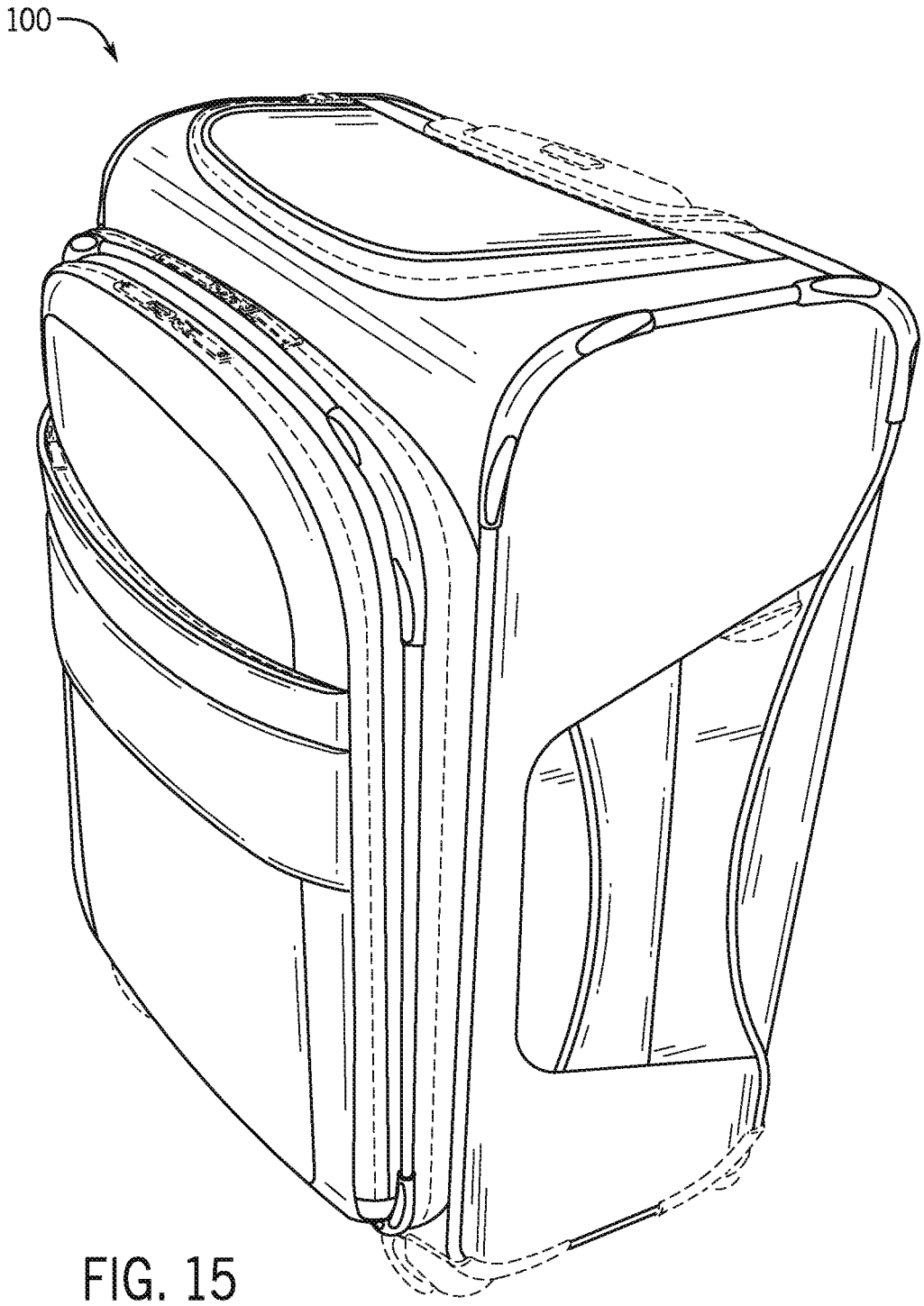
FIG. 15 is a perspective view of a luggage article according to some examples of the present disclosure.
Figure 16:
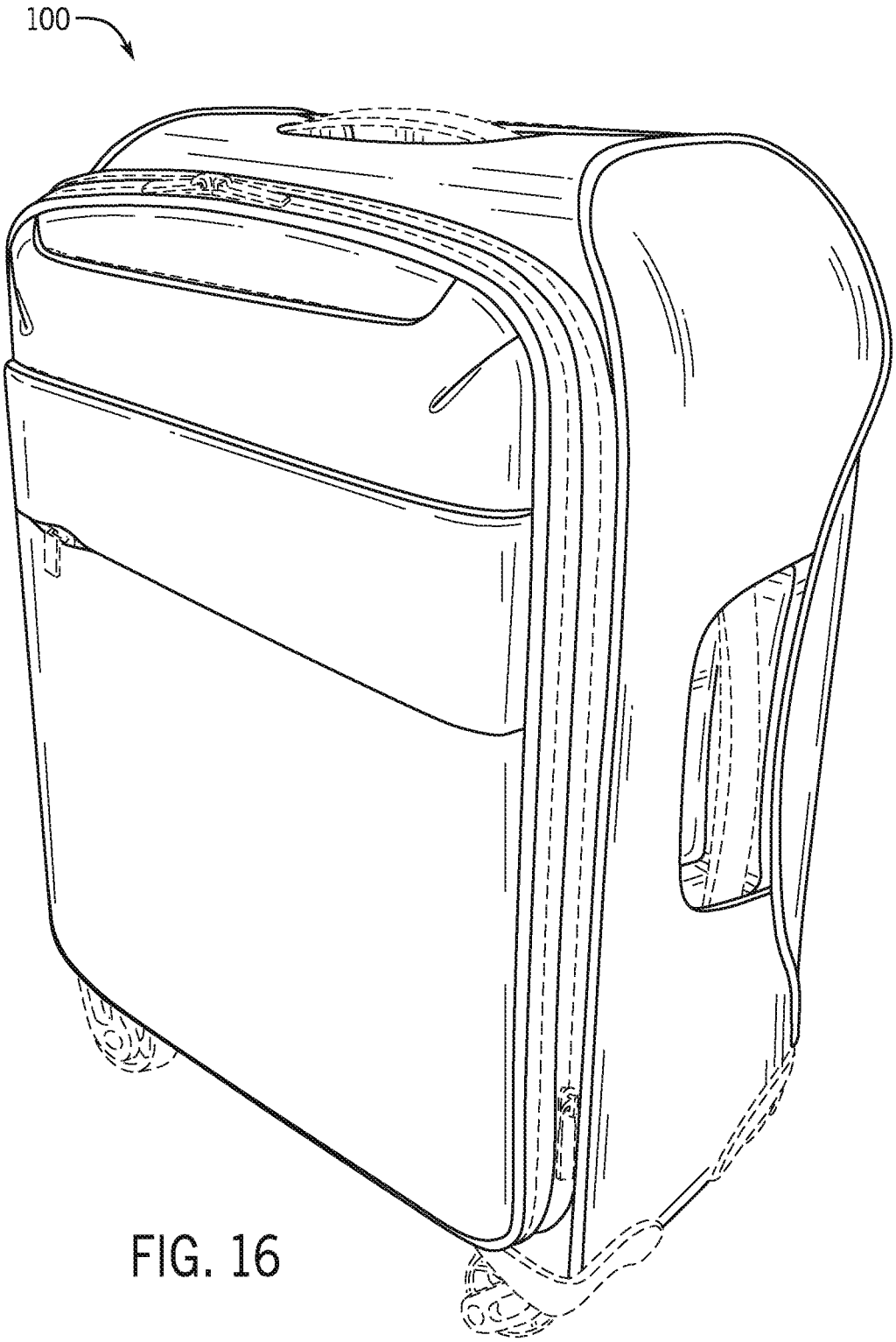
FIG. 16 is a perspective view of an additional luggage article according to some examples of the present disclosure.

FIG. 15 is a perspective view of a luggage article 100 according to some examples of the present disclosure. FIG. 16 is a perspective view of an additional luggage article 100 according to some examples of the present disclosure. Referring to FIGS. 15 and 16, the luggage article 100 may include a housing 102 defined by opposing front and rear panels 104, 106, opposing left and right side panels 112, 114, and opposing top and bottom panels 108, 110 together defining front, rear, left, right, top, and bottom sides 118, 120, 126, 128, 122, 124 of the luggage article 100. Any two adjacent sides of the luggage article 100 may intersect to define an edge of the housing 102. At least one of the panels may wrap around an edge of the housing 102 to extend over a plurality of sides of the luggage article 100. In this manner, at least one side of the housing 102 may be defined or covered by a plurality of panels.

The luggage article 100 may be formed from a variety of materials and means. For example, portions of the frame structure 200 may be formed from a thermoplastic material (self-reinforced or fiber reinforced), ABS, polycarbonate, polypropylene, polystyrene, PVC, polyamide, and/or PTFE, among others. In some examples, the closed loop frame 204 and the panel frame 300 may be extruded from aluminum or other similar metal. In addition, the closed loop frame 204 and the panel frame 300 may be formed from fiber reinforced epoxy, resin, or other similar material. The bottom panel 110 may include a honeycomb structure. For example, the bottom pan assembly 210 may include a honeycomb design. The frame structure 200 may be formed or molded in any suitable manner, such as by plug molding, blow molding, injection molding, extrusion, casting, or the like.

As noted above, the luggage article 100 may be formed from softside material and/or hardside material. The softside material may be nylon, canvas, polyester, leather, PVC, polypropylene, polyethylene, and/or PTFE, among others. The hardside material may be a thermoplastic material (self-reinforced or fiber reinforced), ABS, polycarbonate, polypropylene, polystyrene, PVC, polyamide, and/or PTFE, among others.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article comprising:

opposing front and rear panels, opposing left and right side panels, and opposing top and bottom panels together defining front, rear, left, right, top, and bottom sides of the luggage article;

a panel structure including a central portion extending over the rear side, and first and second side portions extending from opposing lateral sides of the central portion, the first and second side portions extending over at least part of the opposing left and right sides, and each of the first and second side portions including a distal edge and a middle portion of the edge defining a curved shape; and a closed loop frame including a frame portion matching and aligned with the distal edge of the first side portion or the second side portion of the panel structure, the closed loop frame further including a middle portion defining a curved shape.

2. The luggage article of claim 1, wherein one of the first and second side portions supports one of the opposing left and right side panels.

3. The luggage article of claim 1, wherein at least a portion of the side portion extends at least as far as a center line of the side panel.

4. The luggage article of claim 1, wherein the closed loop frame comprises a wire loop.

5. The luggage article of claim 1, wherein the closed loop frame comprises:

a front section;

top and bottom sections extending from opposing ends of the front section; and a rear section extending from the top and bottom sections, the rear section including a shape matching and aligned with the distal edge of the first side portion or the second side portion of the panel structure.

6. The luggage article of claim 5, wherein the rear section includes a central section curved inwardly toward the front section to match and align with the distal edge of the first side portion or the second side portion of the panel structure.

7. The luggage article of claim 5, wherein the distal edge of the first side portion or second side portion is curved toward the front side to match and align with the rear section of the closed loop frame.

8. The luggage article of claim 7, wherein the distal edge of the first side portion or the second side portion has an arcuate shape.

9. The luggage article of claim 8, wherein an apex of the arcuate shape is positioned in a middle portion of the length of the left or right side.

10. The luggage article of claim 5, wherein:

the front, top, and bottom sections of the closed loop frame are substantially linear;

the top and bottom sections extend substantially perpendicularly from the front section; and the rear section connects the ends of the top and bottom sections together.

11. The luggage article of original claim 6, wherein the rear section is curved toward the front section.

12. The luggage article of claim 11, wherein the rear section is a long side of the closed loop frame, and the curve has an arcuate shape.

13. The luggage article of claim 2, wherein an apex of the curved shape is positioned in a middle portion of the length of the left or right side.

14. The luggage article of claim 1, wherein the closed loop frame is coupled to the distal edge of the first side portion or the second side portion of the panel structure.

15. The luggage article of claim 1, further comprising an outer fabric cover over at least part of the front, left, and right sides and a fabric seam aligned with the distal edges of the first and second side portions of the panel structure.

16. The luggage article of claim 1, wherein the first and second side portions are resiliently bent from the central portion to extend over at least part of the opposing left and right sides of the luggage article.

17. The luggage article of claim 1, wherein the luggage article comprises:

a first closed loop frame supporting the left side panel of the housing, the first closed loop frame including a frame portion matching and aligned with the distal edge of the first side portion; and a second closed loop frame supporting the right side panel of the housing, the second closed loop frame including a frame portion matching and aligned with the distal edge of the second side portion.

18. The luggage article of claim 1, wherein the panel structure includes a top portion extending over at least part of the top side.

19. The luggage article of claim 18, wherein:

the closed loop frame is a wire loop and includes an upper top portion, the upper portion extends at least partially over the top side;

the top portion of the panel structure defines a curved side; and the upper portion of the closed loop frame mates with the curved side of the top portion of the panel structure.

20. The luggage article of claim 18, wherein the top portion extends over a top front edge of the front side to form a top lip over a part of the top portion of the front side.

21. The luggage article of claim 18, wherein the panel structure includes a bottom portion extending over at least part of the bottom side of the luggage article.

22. The luggage article of claim 11, wherein the bottom portion extends over a bottom front edge of the top side to form a bottom lip over a part of the bottom portion of the front side.

23. The luggage article of claim 21, wherein:

a brace is coupled between the top portion of the panel structure and a bottom portion of the panel structure along left and right sides, and extends along a central portion between the front and back sides.

24. The luggage article of claim 23, wherein the brace is formed of two separate braces.

25. The luggage article of claim 1, wherein at least one wheel is positioned on the bottom side.

26. The luggage article of claim 25, wherein four wheels are positioned on the bottom side.

27. The luggage article of claim 1, further comprising a door opening formed on the front side to selectively access the interior of the luggage case.

28. The luggage article of claim 1, wherein the closed loop frame may include a top portion, and wherein the top portion may extend at least partially over the top side.

29. The luggage article of claim 28, wherein the closed loop frame is a wire loop frame.

30. A luggage article comprising:

a housing defining a rear edge between a left or right side and a rear side;

a panel structure including a first portion extending around the rear edge of the housing, the first portion having a middle portion defining a curved shape; and a closed loop frame including a frame portion matching and aligned with the first portion of the panel structure.

31. The luggage article of claim 30, wherein the first portion defines at least one curve; and the frame portion defines a mating curve to match and align with the curve defined by the first portion.

32. The luggage article of claim 30, wherein:

the housing includes a rear panel, a left side panel, and a right side panel together defining the rear, left, and right sides of the housing, the intersection between the rear side and the left side defining a left rear edge, the intersection between the rear side and right side defining a right rear edge;

the first portion of the panel structure curves around the left rear edge of the housing to extend at least partially over the left side of the housing;

the panel structure includes a second portion extending around the right rear edge of the housing to extend at least partially over the right side of the housing;

the closed loop frame is a first closed loop frame supporting the left side panel of the housing; and the luggage article includes a second closed loop frame supporting the right side panel of the housing, the second closed loop frame including a frame portion matching and aligned with the second portion of the panel structure.

33. The luggage article of claim 32, wherein the first and second portions of the panel structure extend over only a rear portion of the left and right sides of the housing adjacent to the rear side.

34. The luggage article of claim 30, wherein the closed loop frame includes a nonrectangular shape.

35. A luggage article comprising:

opposing front and rear panels, opposing left and right side panels, and opposing top and bottom panels together defining front, rear, left, right, top, and bottom sides of the luggage article;

the back panel including a panel structure defining opposing side portions, each side portion defining a central curved distal edge, each extending around to cover at least a portion of the opposing left and right sides, respectively; and a closed loop frame including a frame portion matching and aligned with the curved distal edge.

36. The luggage article of claim 35, wherein the side portions extend at least as far as a centerline of the left and right sides.

37. The luggage article of claim 35, wherein the side portions extend no further than a centerline of the left and right sides.

38. A luggage article comprising:

opposing front and rear panels, opposing left and right side panels, and opposing top and bottom panels together defining front, rear, left, right, top, and bottom sides of the luggage article;

one of the left or right side panels being non-rectangular, and including an edge having a middle portion defining a curved shape; and a closed loop frame including a frame portion matching and aligned with the edge of the left or right side panel.

39. A luggage article of claim 38, wherein the one of the left or right side panels defines opposing long sides, with one of the long sides curved inwardly toward the other of the long sides.

40. A luggage article of claim 38, wherein the one of the left of right side panels defines opposing short sides, with one of the short sides curved outwardly away from the other short side.

41. A luggage article comprising:

a housing defined by opposing front and rear panels, opposing left and right side panels, and opposing top and bottom panels together defining front, rear, left, right, top, and bottom sides of the luggage article;

wherein at least one of the panels includes an edge having a middle portion defining a curved shape, and wraps around an edge of the housing to extend over a plurality of sides of the luggage article; and a closed loop frame including a frame portion matching and aligned with the edge of said at least one of the panels.

* * * * *